US011295683B2

(12) United States Patent
Aoki et al.

(10) Patent No.: US 11,295,683 B2
(45) Date of Patent: Apr. 5, 2022

(54) LIQUID CRYSTAL PROJECTOR

(71) Applicant: SEIKO EPSON CORPORATION, Tokyo (JP)

(72) Inventors: Toru Aoki, Shiojiri (JP); Daigo Hokazono, Chino (JP); Kazuhisa Mizusako, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/075,699

(22) Filed: Oct. 21, 2020

(65) Prior Publication Data

US 2021/0125571 A1 Apr. 29, 2021

(30) Foreign Application Priority Data

Oct. 23, 2019 (JP) ..... JP2019-192573

(51) Int. Cl.
*G09G 3/36* (2006.01)
*G02F 1/133* (2006.01)

(52) U.S. Cl.
CPC ..... *G09G 3/3607* (2013.01); *G09G 3/3674* (2013.01); *G09G 3/3688* (2013.01); *G09G 2320/0252* (2013.01); *G09G 2320/041* (2013.01); *G09G 2340/16* (2013.01)

(58) Field of Classification Search
CPC ..... H04N 5/74; H04N 13/04; H04N 9/31; G09G 3/00; G09G 3/20; G09G 3/30; G09G 3/36; G09G 5/00; G09G 5/10; G09G 3/3607; G09G 3/3674; G09G 3/3688; G09G 2320/0252; G09G 2320/041; G09G 2340/16; G02B 1/14; G02B 3/00; G02B 21/00; G02B 21/26; G02F 1/133; G02F 1/137; G02F 1/1333; G02F 1/1335; G02F 1/1337; G02F 1/1343; G02F 1/1339
See application file for complete search history.

(56) References Cited

U.S. PATENT DOCUMENTS

2003/0006949 A1 1/2003 Sekiya et al.
2005/0083353 A1 4/2005 Maruyama et al.
(Continued)

FOREIGN PATENT DOCUMENTS

JP H0463332 2/1992
JP H04288589 10/1992
(Continued)

*Primary Examiner* — Chanh D Nguyen
*Assistant Examiner* — Nguyen H Truong
(74) *Attorney, Agent, or Firm* — JCIPRNET

(57) ABSTRACT

In a liquid crystal projector, in a first liquid crystal panel corresponding to a first color, a gray scale level specified by video data specifies a first value in a first field, and a second value in a second field subsequent to the first field, and in a second liquid crystal panel corresponding to a second color, a gray scale level specified by the video data specifies the first value in the first field, and the second value in the second field. When optical responsiveness of the first liquid crystal panel is better than optical responsiveness of the second liquid crystal panel, in the second field, a liquid crystal voltage applied to the first liquid crystal panel is smaller than a liquid crystal voltage applied to the second liquid crystal panel.

7 Claims, 32 Drawing Sheets

(56) References Cited

U.S. PATENT DOCUMENTS

| | | | | |
|---|---|---|---|---|
| 2005/0179854 | A1* | 8/2005 | Sekine | H04N 9/3144 349/161 |
| 2011/0234650 | A1* | 9/2011 | Watanabe | G09G 5/399 345/690 |
| 2012/0001951 | A1 | 1/2012 | Katagawa | |
| 2013/0162917 | A1* | 6/2013 | Sagawa | H04N 9/3155 349/5 |
| 2013/0321598 | A1* | 12/2013 | Inoue | H04N 13/351 348/54 |
| 2017/0092217 | A1* | 3/2017 | Mizuno | G09G 3/3685 |

FOREIGN PATENT DOCUMENTS

| | | |
|---|---|---|
| JP | H06189232 | 7/1994 |
| JP | 2616652 | 6/1997 |
| JP | 3167351 | 5/2001 |
| JP | 2003029713 | 1/2003 |
| JP | 2005141190 | 6/2005 |
| JP | 2008039868 | 2/2008 |
| JP | 2012013815 | 1/2012 |

* cited by examiner

<PIXELS OF VIDEO DATA>

| | | | | | |
|---|---|---|---|---|---|
| A1 | A2 | A3 | A4 | A5 | A6 |
| B1 | B2 | B3 | B4 | B5 | B6 |
| C1 | C2 | C3 | C4 | C5 | C6 |
| D1 | D2 | D3 | D4 | D5 | D6 |
| E1 | E2 | E3 | E4 | E5 | E6 |
| F1 | F2 | F3 | F4 | F5 | F6 |

<PANEL PIXELS>

| | | |
|---|---|---|
| a1 | a2 | a3 |
| b1 | b2 | b3 |
| c1 | c2 | c3 |

FIG. 4

<PIXELS OF VIDEO DATA>

| | | | | | |
|---|---|---|---|---|---|
| A1 | A2 | A3 | A4 | A5 | A6 |
| B1 | B2 | B3 | B4 | B5 | B6 |
| C1 | A2 | C3 | A4 | C5 | A6 |
| A2 | D2 | A4 | D4 | A6 | D6 |
| E1 | A2 | E3 | A4 | E5 | A6 |
| A2 | F2 | A4 | F4 | A6 | F6 |

FIG. 14

LIQUID CRYSTAL PROJECTOR

The present application is based on, and claims priority from JP Application Serial Number 2019-192573, filed Oct. 23, 2019, the disclosure of which is hereby incorporated by reference herein in its entirety.

BACKGROUND

1. Technical Field

The present disclosure relates to a liquid crystal projector.

2. Related Art

In a liquid crystal projector, liquid crystal panels are provided for each of three primary colors, for example, R (red), G (green), and B (blue), primary color light is caused to be incident on the liquid crystal panels to generate modulated images for each of the primary colors, these modulated images are synthesized, and the synthesized color image is projected onto a screen or the like.

In the liquid crystal panel used in the liquid crystal projector, blurring occurs as a result of insufficient optical responsiveness to electrical changes. In order to reduce the blurring, there is a so-called overdrive technology (see JP-A-6-189232).

However, in the liquid crystal projector, responsiveness of the liquid crystal panel may be different for each of the colors. Specifically, the responsiveness may vary from color to color depending on differences in an amount of incident light, cell gap differences, and the like. If the responsiveness is different among the liquid crystal panels, when pixels to be synthesized are changed to an achromatic color, the pixels are visually recognized in a colored state since transmittance is not the same in the liquid crystal panels for each of the primary colors.

SUMMARY

In order to solve the problem described above, a liquid crystal projector according to an aspect of the present disclosure includes a display control circuit configured to process and output, as a first data signal, video data of a first color, among video data specifying a gray scale level of a pixel, and to process and output, as a second data signal, video data of a second color different from the first color, among the video data, a first liquid crystal panel provided corresponding to the first color and including a first pixel circuit that applies a first liquid crystal voltage corresponding to the first data signal to liquid crystal, the first pixel circuit emitting light corresponding to a transmittance of the liquid crystal, a second liquid crystal panel provided corresponding to the second color and including a second pixel circuit that applies a second liquid crystal voltage corresponding to the second data signal to liquid crystal, the second pixel circuit emitting light corresponding to a transmittance of the liquid crystal, and a synthesizing unit configured to synthesize the emitted light from the first pixel circuit and the emitted light from the second pixel circuit, and to emit the synthesized light. The gray scale level specified by the video data of the first color specifies a first value in a first field and specifies a second value in a second field subsequent to the first field. The gray scale level specified by the video data of the second color specifies the first value in the first field and the second value in the second field. When optical responsiveness of the first liquid crystal panel is better than optical responsiveness of the second liquid crystal panel, the first liquid crystal voltage in the second field is smaller than the second liquid crystal voltage in the second field.

BRIEF DESCRIPTION OF THE DRAWINGS

FIG. 4 is a diagram illustrating a relationship between pixels of video data and pixels of a liquid crystal panel, and the like FIG. 5 is a diagram illustrating a relationship between the pixels and shift positions of the video data represented by the panel pixels.

FIG. 14 is a diagram illustrating an example of a still image specified by the video data.

DESCRIPTION OF EXEMPLARY EMBODIMENTS

An electro-optical device according to embodiments will be described below with reference to the accompanying diagrams. Note that in each of the diagrams, dimensions and a scale of each unit is different from actual dimensions and scale, as appropriate. In addition, since the embodiments to be described below are specific preferred examples, various technically preferable limitations are attached to the embodiments. Thus, the scope of the present disclosure is not limited to these embodiments unless otherwise stated to limit the present disclosure in the following description.

Figure 1:
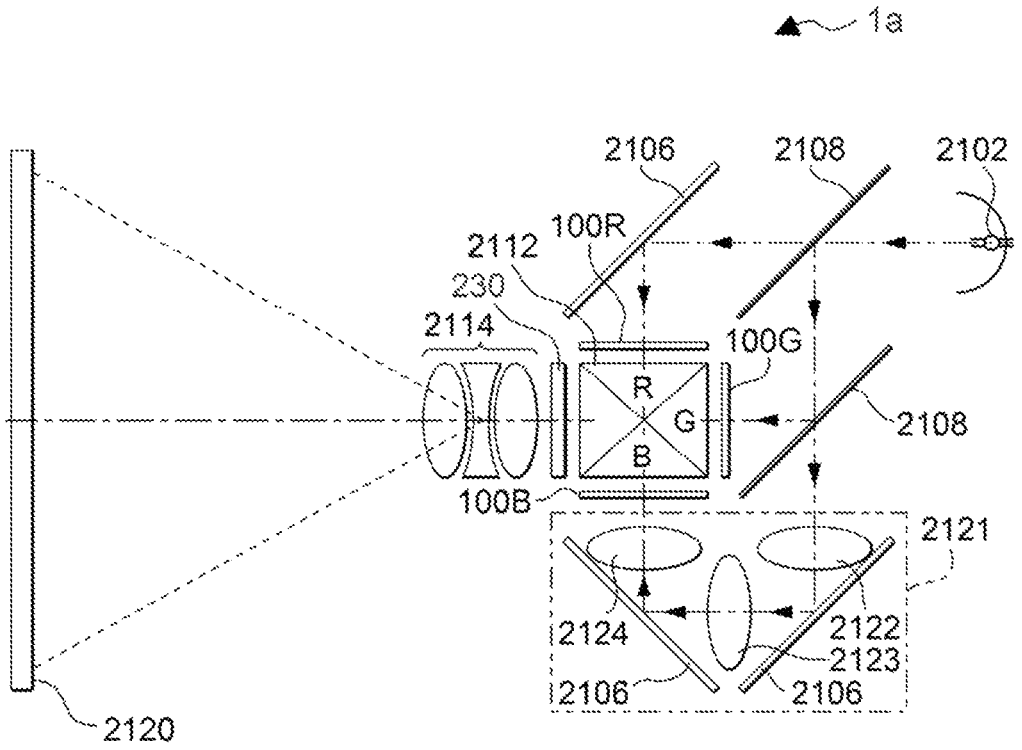
FIG. 1 is a diagram illustrating an optical configuration of a liquid crystal projector according to an embodiment.

FIG. 1 is a diagram illustrating an optical configuration of a liquid crystal projector 1*a* according to an embodiment. As illustrated in FIG. 1, the liquid crystal projector 1*a* includes liquid crystal panels 100R, 100G, and 100B. Further, a lamp unit 2102 including a white light source, such as a halogen lamp, is provided inside the liquid crystal projector 1*a*. Light emitted from this lamp unit 2102 is split into three primary colors of R, G, and B by three mirrors 2106 and two dichroic mirrors 2108 disposed internally. Of the light, light R, light G, and light B are incident on the liquid crystal panel 100R, the liquid crystal panel 100G, and the liquid crystal panel 100B, respectively.

Note that an optical path of B is longer than those of R and G. Thus, the light B is guided to the liquid crystal panel 100B via a relay lens system 2121 configured by an incidence lens 2122, a relay lens 2123, and an emission lens 2124, in order to prevent loss in the optical path.

The liquid crystal panel 100R includes pixel circuits arranged in a matrix pattern as described below. In the pixel circuit, transmittance of light emitted from a liquid crystal element is controlled based on a data signal corresponding to R. In other words, in the liquid crystal panel 100R, the emitted light from the liquid crystal element functions as the smallest unit of an image. By such control, the liquid crystal panel 100R generates a transmission image of R based on the data signal corresponding to R. Similarly, the liquid crystal panel 100G generates a transmission image of G based on a data signal corresponding to G, and the liquid crystal panel 100B generates a transmission image of B based on a data signal corresponding to B.

The transmission image of each of the colors respectively generated by the liquid crystal panels 100R, 100G, and 100B is incident on a dichroic prism 2112 from three directions. Then, at the dichroic prism 2112, the light R and the light B are refracted at 90 degrees, whereas the light G travels in a straight line. Therefore, the dichroic prism 2112 synthesizes an image of each of the colors. The light synthesized by the dichroic prism 2112 is incident on a projection lens 2114 via a shift device 230. The shift device 230 shifts an emission direction from the dichroic prism 2112. Specifically, the shift device 230 can shift an image to be projected on a screen 2120 in the left-right direction and the up-down direction with respect to a projection surface.

The projection lens 2114 enlarges and projects the synthesized image received via the shift device 230 onto the screen 2120.

For convenience of explanation, in order to distinguish pixels to be projected on the screen 2120 from pixels generated as a result of synthesis by the liquid crystal panels 100R, 100G, and 100B, the pixels to be projected on the screen 2120 are referred to as projection pixels, and the pixels generated as a result of the synthesis by the liquid crystal panels 100R, 100G, and 100B are referred to as panel pixels. Further, a position of the projection pixel that is projected via the shift device 230 is simply referred to as a projection position.

Note that the transmission images from the liquid crystal panels 100R and 100B are projected after being reflected by the dichroic prism 2112, whereas the transmission image from the liquid crystal panel 100G travels in a straight line and is projected. Thus, each of the transmission images from the liquid crystal panels 100R and 100B has an inverted relationship in the left-right direction with respect to the transmission image from the liquid crystal panel 100G.

Figure 2:
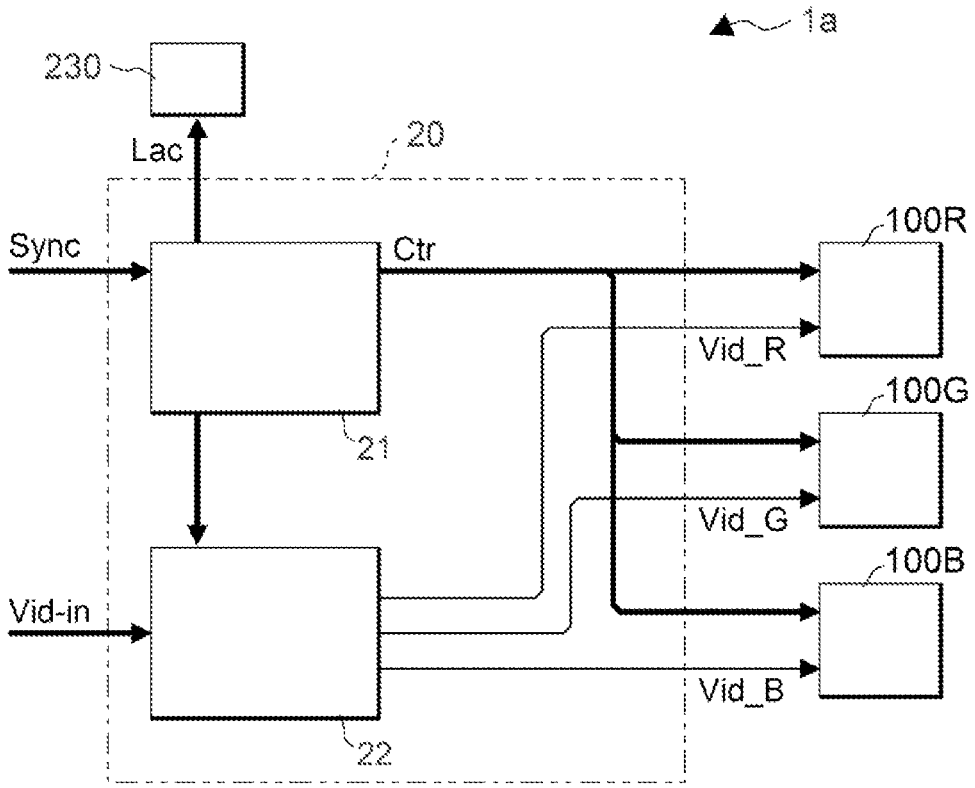
FIG. 2 is a block diagram illustrating an electrical configuration of the liquid crystal projector.

FIG. 2 is a block diagram illustrating an electrical configuration of the liquid crystal projector 1*a*. As illustrated in FIG. 2, the liquid crystal projector 1*a* includes a display control circuit 20, the liquid crystal panels 100R, 100G, and 100B, and the shift device 230.

Video data Vid-in is supplied to the display control circuit 20 from a higher device such as a host device (not illustrated) while being synchronized with a synchronizing signal Sync. The video data Vid-in is data representing an image to be displayed on the liquid crystal projector 1*a*, and more specifically, specifies gray scale levels of the pixels in the image, for example, by 8 bits for each of RGB.

The synchronization signal Sync includes a vertical synchronization signal indicating a start of vertical scanning in the video data Vid-in, a horizontal synchronization signal indicating a start of horizontal scanning, and a clock signal indicating a timing for one pixel of the video data.

In the present embodiment, a color image projected onto the screen 2120 is represented by the transmission images of the liquid crystal panels 100R, 100G, and 100B being superimposed on top of each other. Thus, the pixel, which is the smallest unit of the color image, can be divided into a red panel pixel from the liquid crystal panel 100R, a green panel pixel from the liquid crystal panel 100G, and a blue panel pixel from the liquid crystal panel 100B.

Note that, strictly speaking, although the red panel pixel, the green panel pixel, and the blue panel pixel should be described as subpixels, in the present description, these pixels are described as the panel pixels as described above.

The liquid crystal panels 100R, 100G, and 100B only differ in the color of incident light, namely, in the wavelength, and have the same structure. Thus, when there is no need to specify the color for describing the liquid crystal panels 100R, 100G, and 100B, these liquid crystal panels will be denoted by a reference sign 100.

The display control circuit 20 includes a scanning control circuit 21 and a video processing circuit 22.

In the present embodiment, the pixel arrangement of the image specified by the video data Vid-in is twice greater than the arrangement of the panel pixels in the liquid crystal panel 100, for example, twice greater in the vertical direction and twice greater in the horizontal direction. Thus, in the present embodiment, in order to artificially increase the resolution, a projection direction is shifted by the shift device 230.

More specifically, when one frame of the image specified by the video data Vid-in is displayed, a time period for displaying the one frame is divided into four fields, and the projection position of the panel pixel is shifted for each of the fields. Due to such a shift, one panel pixel is visually recognized as if it is displaying four of the pixels specified by the video data Vid-in. Before describing the scanning control circuit 21 and the video processing circuit 22, a technique for representing the four pixels specified by the video data Vid-in by the one panel pixel in the liquid crystal panel 100 will be described.

Figure 3:
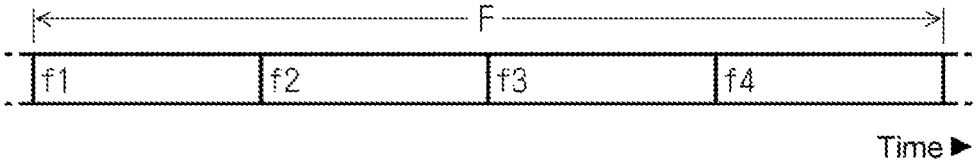
FIG. 3 is a diagram illustrating a relationship between a frame and a field in the liquid crystal projector.

FIG. 3 is a diagram illustrating a relationship between the frame and the field according to the present embodiment. As illustrated in FIG. 3, in the present embodiment, one frame F is divided into four fields. Note that in order to distinguish the four fields in the frame F for convenience of explanation, reference signs f1, f2, f3, and f4 are assigned to the fields in chronological order.

Note that when the frequency of the vertical synchronization signal included in the synchronization signal Sync is 60 Hz, the time length of the frame F is 16.7 milliseconds for one cycle. In this case, the time length of each of the fields f1 to f4 is 4.17 milliseconds.

Next, a relationship between the pixel for which the gray scale level is specified by the video data Vid-in, the panel pixel generated by the liquid crystal panel 100, and the projection position determined by the shift device 230 will be described. Note that although the shift device 230 shifts the projection direction from the dichroic prism 2112 as described above, the shift amount will be described below in terms of the size of the projection pixel on the screen 2120 for convenience of explanation.

The left part of FIG. 4 is a diagram illustrating only a portion of the image represented by the video data Vid-in. Further, the right part of FIG. 4 is a diagram illustrating an arrangement of the panel pixels corresponding to the pixel arrangement in the left part of FIG. 4. Note that the arrangement of the panel pixels is an arrangement of the pixels obtained by synthesizing the transmission images in the liquid crystal panels 100R, 100G and 100B.

In the arrangement illustrated on the left side of FIG. 4, in order to distinguish the pixels in the image represented by the video data Vid-in, for convenience of explanation, reference signs A1 to A6, reference signs B1 to B6, reference signs C1 to C6, and reference signs D1 to D6 are assigned to the first row, the second row, the third row, and the fourth row, respectively. Similarly, in the arrangement illustrated on the right side of FIG. 4, for convenience of explanation, reference signs a1 to a3, reference signs b1 to b3, and reference signs c1 to c3 are assigned to the first row, the second row, and the third row, respectively.

Figure 5:
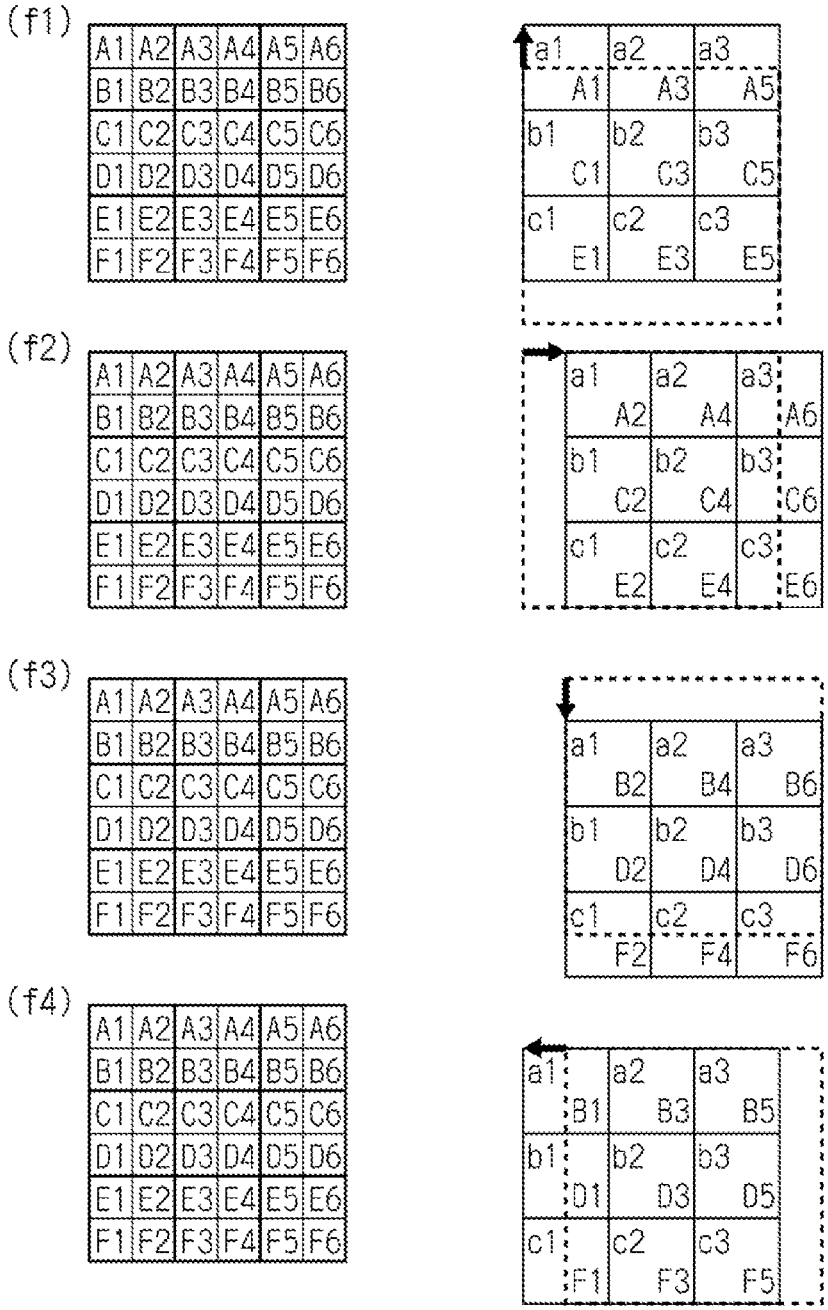

FIG. 5 is a diagram illustrating which pixels of the image represented by the video data Vid-in are displayed at which projection positions by the panel pixels of the liquid crystal panel 100 in the liquid crystal projector 1*a*. More specifically, FIG. 5 is a diagram illustrating which pixels in the pixel arrangement represented by the video data Vid-in illustrated on the left side of FIG. 4 are displayed at which projection positions in the fields f1 to f4 by the nine panel pixels of the liquid crystal panel 100 illustrated on the right side of FIG. 4.

The projection positions in the field f1 of the frame F are defined as reference positions. In the field f1, the panel pixels a1 to a3, b1 to b3, and c1 to c3 respectively display the pixels A1, A3, and A5, the pixels C1, C3, and C5, and the pixels E1, E3, and E5 of the video data Vid-in, in this order.

In the next field f2, the shift device 230 shifts the projection positions from the projection positions in the field f1 indicated by the dashed line, by 0.5 pixel of the liquid crystal panel 100 in the rightward direction in FIG. 5. Further, in the field f2, the panel pixels a1 to a3, b1 to b3, and c1 to c3 respectively display the pixels A2, A4, and A6, the pixels C2, C4, and C6, and the pixels E2, E4, and E6 of the video data Vid-in, in this order.

In the next field f3, the shift device 230 shifts the projection positions from the projection positions in the field f2 indicated by the dashed line, by 0.5 pixel of the liquid crystal panel 100 in the downward direction in FIG. 5. Further, in the field f3, the panel pixels a1 to a3, b1 to b3, and c1 to c3 respectively display the pixels B2, B4, and B6, the pixels D2, D4, and D6, and the pixels F2, F4, and F6 of the video data Vid-in, in this order.

Then, in the field f4, the shift device 230 shifts the projection positions from the projection positions in the field f3 indicated by the dashed line, by 0.5 pixel of the liquid crystal panel 100 in the leftward direction in FIG. 5. Further, in the field f4, the panel pixels a1 to a3, b1 to b3, and c1 to c3 respectively display the pixels B1, B3, and B5, the pixels D1, D3, and D5, and the pixels F1, F3, and F5 of the video data Vid-in, in this order.

After the field f4, the shift device 230 shifts the projection positions from the projection positions in the field f4 indicated by the dashed line, by 0.5 pixel of the liquid crystal panel 100 in the upward direction in FIG. 5, and returns the projection positions to the positions in the field f1.

Returning again to FIG. 2, the scanning control circuit 21 generates control signals Ctr for controlling scanning of the liquid crystal panels 100R, 100G, and 100B for each of the fields. Further, the scanning control circuit 21 generates control signals Lac for controlling the projection positions determined by the shift device 230 for each of the fields.

Although details will be described below, the video processing circuit 22 temporarily stores the video data Vid-in and reads out the video data, of the stored video data Vid-in, corresponding to the pixels to be displayed in the field. Furthermore, the video processing circuit 22 processes the read-out video data by color to convert the video data into an analog format, and outputs the video data as data signals Vid-R, Vid-G, and Vid-B. Of those, the data signal Vid-R is a signal in which a component R of the video data Vid-in has been processed, and supplied to the liquid crystal panel 100R. Similarly, the data signal Vid-G is a signal in which a component G of the video data Vid-in has been processed, and supplied to the liquid crystal panel 100G. The data signal Vid-B is a signal in which a component B of the video data Vid-in has been processed, and supplied to the liquid crystal panel 100B.

Next, the liquid crystal panels 100R, 100G, and 100B will be generally described without specifying the color.

Figure 6:
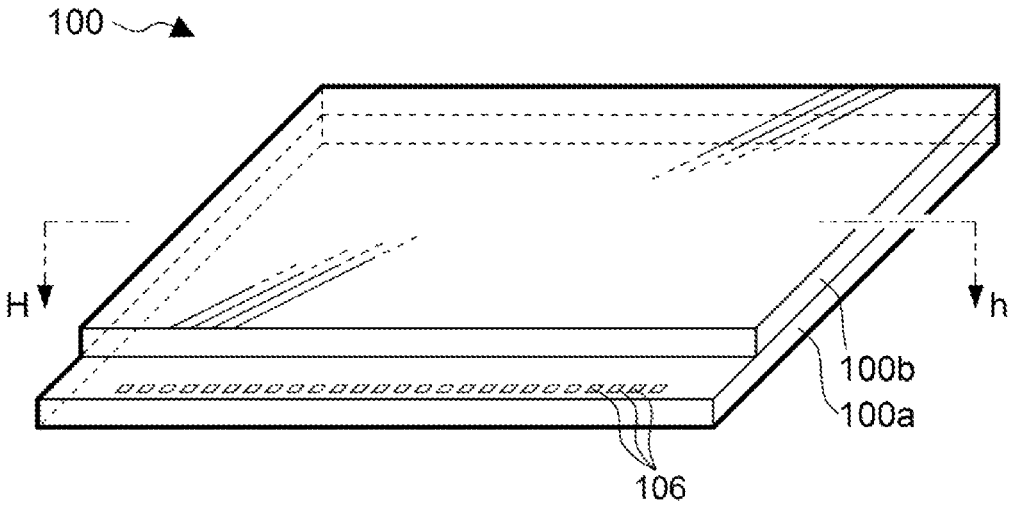
FIG. 6 is a perspective view of the liquid crystal panel in the liquid crystal projector.
Figure 7:
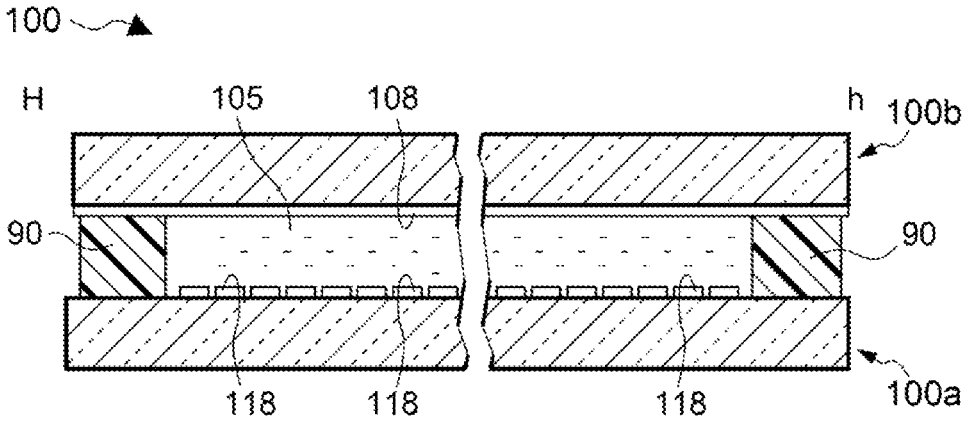
FIG. 7 is a cross-sectional view illustrating a structure of the liquid crystal panel.

FIG. 6 is a diagram illustrating main portions of the liquid crystal panel 100, and FIG. 7 is a cross-sectional view taken along a line H-h in FIG. 6.

As illustrated in these drawings, in the liquid crystal panel 100, an element substrate 100*a* provided with pixel electrodes 118 and a counter substrate 100*b* provided with a common electrode 108 are bonded to each other so that electrode forming surfaces thereof face each other while a constant gap therebetween is maintained by a sealing material 90 including a spacer (not illustrated), and liquid crystal 105 is sealed in this gap. Note that the gap between the element substrate 100*a* and the counter substrate 100*b* is commonly referred to as a cell gap.

A light-transmissive substrate, such as glass or quartz, is used as the element substrate 100*a* and the counter substrate 100*b*. As illustrated in FIG. 6, one side of the element substrate 100*a* protrudes from the counter substrate 100*b*. A plurality of terminals 106 are provided along the one side in the protruding region. One end of a FPC board 74 is coupled to the plurality of terminals 106. The other end of the FPC board 74 is coupled to the display control circuit 20, and the above-described various signals and the like are supplied to the display control circuit 20.

On a surface of the element substrate 100*a* facing the counter substrate 100*b*, the pixel electrodes 118 are formed by patterning a transparent conductive layer, such as ITO, for example. Note that ITO is an abbreviation for indium tin oxide.

Further, on the surface of the element substrate 100*a* facing the counter substrate 100*b* and the surface of the counter substrate 100*b* facing the element substrate 100*a*, various elements are provided besides the electrodes, but they are not illustrated in the drawings.

Figure 8:
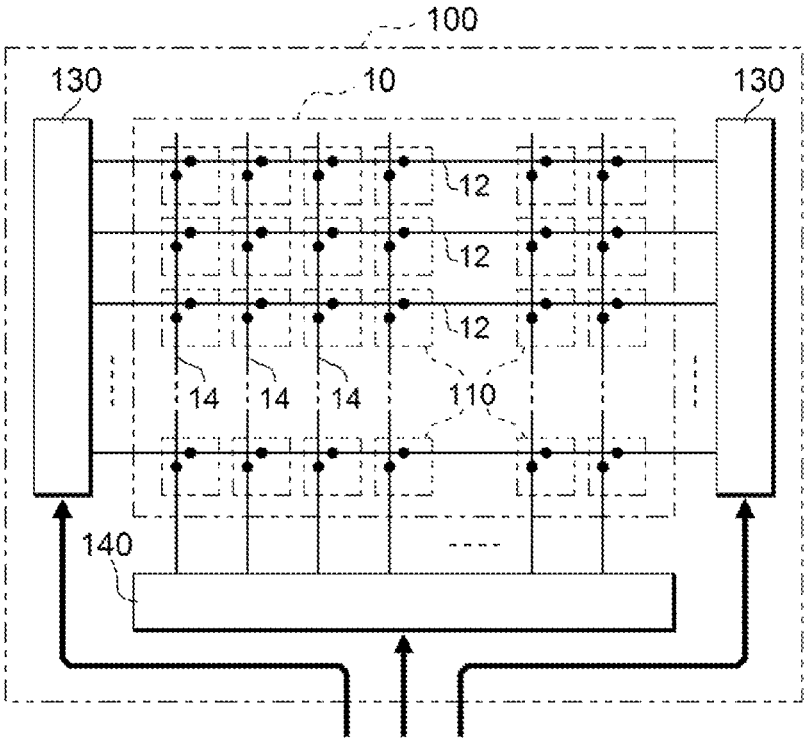
FIG. 8 is a block diagram illustrating an electrical configuration of the liquid crystal panel.

FIG. 8 is a block diagram illustrating an electrical configuration of the liquid crystal panel 100. Scanning line drive circuits 130 and a data line drive circuit 140 are provided along the peripheral edge of a display region 10 in the liquid crystal panel 100.

In the display region 10 of the liquid crystal panel 100, pixel circuits 110 are arranged in a matrix pattern. More specifically, in the display region 10, a plurality of scanning lines 12 are provided extending in the horizontal direction in FIG. 8, and a plurality of data lines 14 extend in the vertical direction in the drawing. The scanning lines 12 and the data lines 14 are provided so as to be electrically insulated from each other. Then, the pixel circuits 110 are provided in the matrix pattern so as to correspond to intersections between the plurality of scanning lines 12 and the plurality of data lines 14.

When the number of scanning lines 12 is m and the number of data lines 14 is n, the pixel circuits 110 are arranged in the matrix pattern having m rows vertically and n columns horizontally. Both m and n are integers equal to or greater than two. With respect to the scanning lines 12 and the pixel circuits 110, in order to distinguish the rows from one another in the matrix, the rows may be referred to as a 1st, 2nd, 3rd, . . . , (m−1)th, and mth row in order from the top in the drawing. Similarly, with respect to the data lines 14 and the pixel circuits 110, in order to distinguish the columns from one another in the matrix, the columns may be referred to as a 1st, 2nd, 3rd, . . . , (n−1)th, and nth column in order from the left in the drawing.

In accordance with control by the scanning control circuit 21, the scanning line drive circuit 130 selects the scanning line 12 one by one in the order of, for example, the 1st, 2nd. 3rd, . . . , and mth row, and sets a scanning signal to the selected scanning line 12 to an H level. Note that the scanning line drive circuit 130 sets scanning signals to the scanning lines 12 other than the selected scanning line 12 to an L level.

The data line drive circuit 140 latches the data signal for one row supplied from the video processing circuit 22 in accordance with the control by the scanning control circuit 21, and outputs, during a period in which the scanning signal to the selected scanning line 12 is set to the H level, the data signal to the pixel circuit 110 located at the scanning line 12 via the data line 14.

Figure 9:
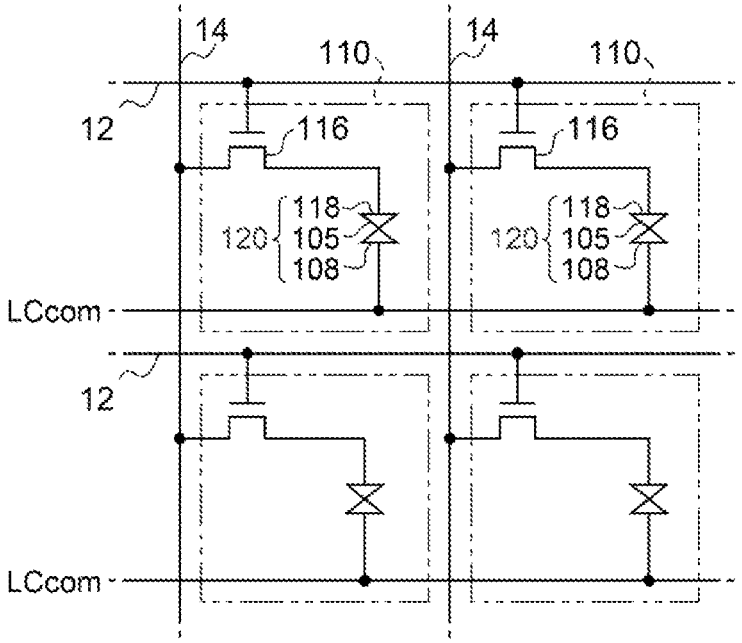
FIG. 9 is a diagram illustrating a configuration of a pixel circuit in the liquid crystal panel.

FIG. 9 is a diagram illustrating equivalent circuits of four of the pixel circuits 110 in total having two rows and two columns corresponding to the intersections between two of the adjacent scanning lines 12 and two of the adjacent data lines 14.

As illustrated in FIG. 9, the pixel circuit 110 includes a transistor 116 and a liquid crystal element 120. The transistor 116 is, for example, an n-channel thin film transistor. In the pixel circuit 110, a gate node of the transistor 116 is coupled to the scanning line 12, while a source node of the transistor 116 is coupled to the data line 14, and a drain node of the transistor 116 is coupled to the pixel electrode 118, which is substantially square in plan view.

The common electrode 108 is commonly provided for all the pixel circuits 110 so as to face the pixel electrodes 118. A voltage LCcom is applied to the common electrode 108. Then, the liquid crystal 105 is sandwiched between the pixel electrodes 118 and the common electrode 108 as described above. Therefore, the liquid crystal element 120 is configured in which the liquid crystal 105 is sandwiched between the pixel electrode 118 and the common electrode 108, for each of the pixel circuits 110.

Note that a storage capacitor may be provided in parallel with the liquid crystal element 120, but the storage capacitor is omitted in the drawing as it is not important in the present case.

On the scanning line 12 for which the scanning signal is set to the H level, the transistor 116 of the pixel circuit 110 provided corresponding to the scanning line 12 is turned on. As a result of the transistor 116 being turned on, a state is obtained in which the data line 14 and the pixel electrode 118 are electrically coupled to each other. Thus, the data signal supplied to the data line 14 reaches the pixel electrode 118 via the turned-on transistor 116. Although the transistor 116 is turned off when the scanning line 12 is switched to the L level, the voltage of the data signal that has reached the pixel electrode 118 is retained by capacitive properties of the liquid crystal element 120.

As is known, in the liquid crystal element 120, an orientation of liquid crystal molecules changes in accordance with an electric field generated by the pixel electrode 118 and the common electrode 118. Accordingly, the liquid crystal element 120 has a transmittance corresponding to an effective value of the applied voltage. Note that in the present embodiment, the liquid crystal element 120 is in a normally black mode in which the transmittance increases as the applied voltage increases.

As a result of the operation of supplying the data signal to the pixel electrode 118 of the liquid crystal element 120 being performed to each of the 1st, 2nd, 3rd, . . . , and mth rows in this order, the voltage corresponding to the data signal is retained in each of the liquid crystal elements 120 of the pixel circuits 110 arranged in the pattern having the m rows and the n columns. With such retention of the voltage, each of the liquid crystal elements 120 results in having a target transmittance, and a transmission image of a corresponding color is generated by the pixels arranged in the pattern having the m rows and the n columns.

Figure 10:
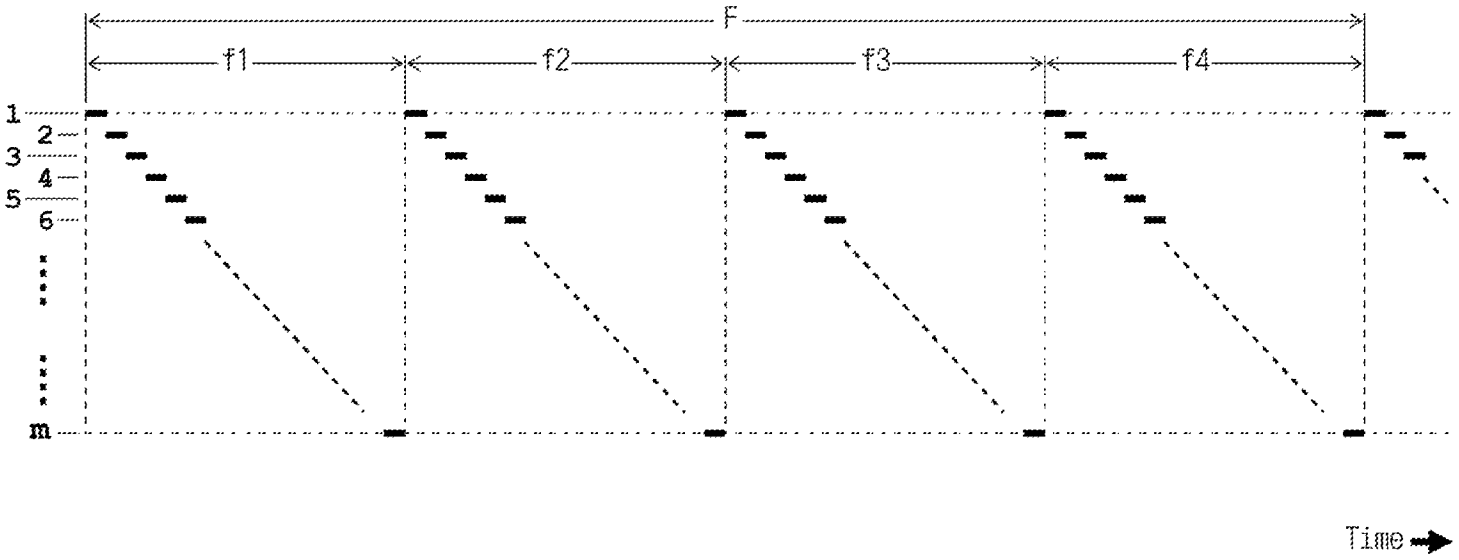
FIG. 10 is a diagram illustrating changes in selection of scanning lines in the liquid crystal panel.

FIG. 10 illustrates temporal changes of the selected scanning line 12, when the 1st row to the mth row, which indicate the row numbers of the scanning lines 12, are on the vertical axis, and an elapsed time is on the horizontal axis.

When the selection of the scanning line 12 is indicated by the thick black lines, since the scanning line 12 is exclusively selected one row at a time, the selected scanning line 12 sequentially transitions from the 1st row to the mth row as the time elapses.

In a given sub-field, when a given scanning line 12 is selected with respect to a given data line 14, a data signal corresponding to the sub-field and the panel pixel is supplied to the pixel circuit 110 corresponding to the intersection between the given scanning line 12 and the given data line 14. Thus, in the given sub-field, the liquid crystal element 120 of the pixel circuit 110 changes so as to have a transmittance corresponding to the voltage of the data signal.

In the present embodiment, the video processing circuit 22 executes processing for overdrive in order to reduce blurring.

Figure 11:
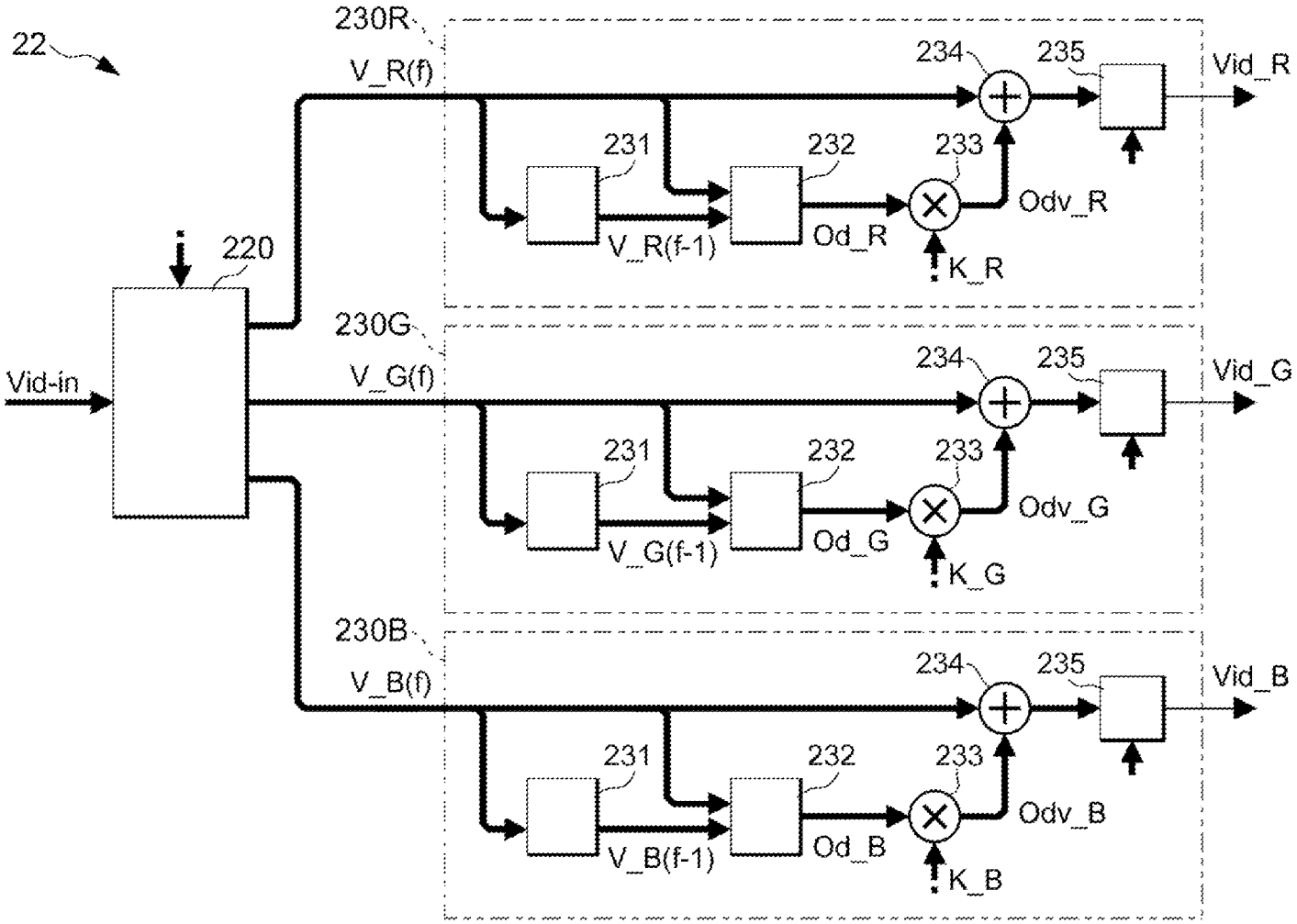
FIG. 11 is a diagram illustrating a configuration of a video processing circuit in an electro-optical device.

FIG. 11 is a block diagram illustrating a configuration of the video processing circuit 22. As illustrated in this diagram, the video processing circuit 22 includes a frame memory 220, and processing circuits 230R, 230G, and 230B.

The frame memory 220 is used to store the video data Vid-in and read out the video data corresponding to the field. More specifically, the frame memory 220 stores the video data Vid-in in accordance with the control by the scanning control circuit 21. Then, from the frame memory 220, the video data Vid-in to be displayed in the panel pixels in a given field is read out by the scanning control circuit 21 in accordance with a scanning timing.

Specifically, the scanning control circuit 21 reads out the following video data Vid-in from the frame memory 220. For example, when the scanning line 12 in the 1st row is selected in the field f1, the scanning control circuit 21 reads out the image data Vid-in corresponding to the pixels A1, A3, A5, . . . among the pixels illustrated on the left side of FIG. 4. When the scanning line 12 in the 2nd row is selected in the field f1, the scanning control circuit 21 reads out the image data Vid-in corresponding to the pixels C1, C3, C5, . . . . Further, for example, when the scanning line 12 in the 1st row is selected in the field f2, the scanning control circuit 21 reads out the image data Vid-in corresponding to the pixels A2, A4, A6, . . . . Further, when the scanning line 12 in the 2nd row is selected in the field f2, the scanning control circuit 21 reads out the image data Vid-in corresponding to the pixels C2, C4, C6, . . . . In this way, the video data Vid-in to be displayed in the panel pixels in the given field is read out from the frame memory 220.

Of the video data Vid-in read out from the frame memory 220, the component R is supplied to the processing circuit 230R as video data V_R (f), the component G is supplied to the processing circuit 230G as video data V_G (f), and the component B is supplied to the processing circuit 230B as video data V_B (f).

The processing circuit 230R includes a delay device 231, a LUT 232, a multiplier 233, an adder 234, and a DA converter 235.

The delay device 231 outputs video data V_R (f−1) by delaying the video data V_R (f) by a period corresponding to one field. Note that (f−1) refers to a field immediately prior to (f) and indicates that the field corresponds to the same panel pixels. Further, the reason why the video data V_R (f) is delayed by the period corresponding to one field and output as the video data V_R (f−1) is to determine changes in the gray scale level specified for a given panel pixel for each of the fields, and output data for driving using overdrive in accordance with the changes. Note that in the present embodiment, in order to simplify the explanation, the overdrive data is output by the LUT 232 as described below.

Specifically, the LUT 232 is a two-dimensional look-up table that pre-stores overdrive data Od_R in correspondence with the gray scale level indicated by the video data V_R (f) and the gray scale level indicated by the video data V_R (f−1). From the LUT 232, the data Od_R corresponding to the gray scale level indicated by the video data V_R (f) and the gray scale level indicated by the video data V_R (f−1) is output.

Note that, in terms of decimal values, the data Od_R is a positive value when the gray scale level increases, a negative value when the gray scale level decreases, and zero when the gray scale level does not change.

The multiplier 233 multiplies the data Od_R by a coefficient K_R and outputs the result of the multiplication as correction amount data Odv_R. Note that the coefficient K_R may be freely set in a range from "0" to "1" using decimal values, but here, for convenience of explanation, "1" is used as an initial value thereof.

The adder 234 adds the data Odv_R to the video data V_R (f).

Note that, as described above, since the data Od_R and the data Odv_R may be negative values, actual arithmetic calculation content in the adder 234 includes not only addition, but also subtraction.

The DA converter 235 converts the addition result by the adder 234 into the data signal Vid_R having an analog voltage of a polarity specified by the scanning control circuit 21.

In this way, the processing circuit 230R adds, to the video data V_R (f) of the component R with respect to a given panel pixel, of the video data Vid_in, the correction amount corresponding to the change in the gray scale level from the field immediately prior to the current field with respect to the same panel pixel, converts the addition result into an analog format, and outputs the conversion result to the liquid crystal panel 100R as the data signal Vid_R.

The processing circuits 230G and 230B have the same configuration as that of the processing circuit 230R. In other words, the processing circuit 230G adds, to the video data V_G (f) of the component G of the video data Vid_in, the correction amount corresponding to the change in the gray scale level from the field immediately prior to the current field, converts the addition result to the analog format, and outputs the conversion result to the liquid crystal panel 100G as the data signal Vid_G. Further, the processing circuit 230B adds, to the video data V_B (f) of the component B of the video data Vid_in, the correction amount corresponding to the change in the gray scale level from the field immediately prior to the current field, converts the addition result to the analog format, and outputs the conversion result to the liquid crystal panel 100B as the data signal Vid_B.

Note that the coefficient K_R, and coefficients K_G and K_B are supplied by the scanning control circuit 21 in a changeable manner, for example.

Similarly to the coefficient K_R, the coefficients K_G and K_B can also be freely set in the range from "0" to "1" using decimal values, but for convenience of explanation, "1" is used as an initial value thereof.

Further, here, the conversion content of the output with respect to input in the LUT 232 of the processing circuit 230G, and the conversion content in the LUT 232 of the processing circuit 230B are the same as the conversion content in the LUT 232 of the processing circuit 230R. Thus, the LUT 232 of the processing circuit 230R, the LUT 232 of the processing circuit 230G, and the LUT 232 of the processing circuit 230B may be made common. Further, the overdrive data may be determined by arithmetic calculation rather than by the conversion by the LUT 232.

Incidentally, optical responsiveness of the liquid crystal element 120, and more specifically, the response speed of the transmittance with respect to electrical changes varies depending on the temperature of the liquid crystal 105, for example. Specifically, when the temperature increases, the viscosity of the liquid crystal 105 decreases, and thus, the responsiveness of the liquid crystal element 120 improves, that is, the response speed increases. Conversely, when the temperature decreases, the viscosity of the liquid crystal 105 increases, and thus, the responsiveness of the liquid crystal element 120 deteriorates.

In the liquid crystal projector 1*a*, the temperatures of the liquid crystal panels 100R, 100G, and 100B may not be the same. Specifically, the temperatures of the liquid crystal panels 100R, 100G, and 100B may be defined as $$G \approx R > B \quad (1) \text{ or}$$

$$G > R > B \quad (2).$$

This is because, in the liquid crystal projector 1*a*, there are differences in the amount of light incident on the liquid crystal panels 100R, 100G, and 100B.

In the case of the relational expression (1), the responsiveness of the liquid crystal panel 100G and the 100R are substantially equal, and the responsiveness of the liquid crystal panel 100B is lower than the responsiveness of the liquid crystal panels 100G and 100R. Further, in the case of the relational expression (2), the responsiveness is better in the order of the liquid crystal panels 100G, 100R, and 100B.

Next, what kind of inconveniences arise when the responsiveness of the liquid crystal panels 100G, 100R, and 100B differ from each other will be described. Note that, here, in order to simplify the explanation, the description will be made while assuming that the temperatures of the liquid crystal panels 100G and 100R have the relationship defined in the relational expression (1).

First, a case will be described in which the gray scale level of a given panel pixel changes from a given gray scale level to another gray scale level, with reference to FIGS. 12A, 12B, and 12C.

Figure 12A:
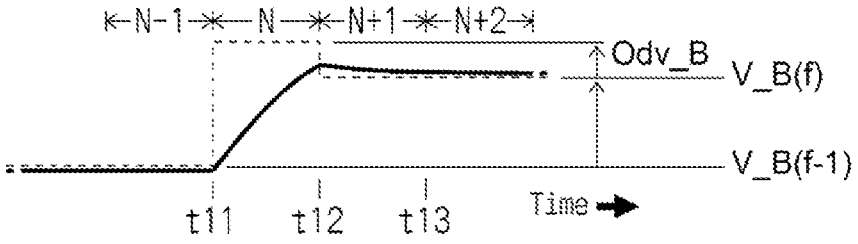
FIG. 12A is a diagram for describing an operation of the video processing circuit.
Figure 12B:
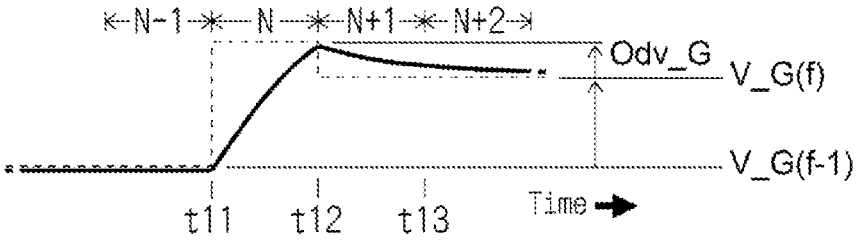
FIG. 12B is a diagram for describing the operation of the video processing circuit.
Figure 12C:
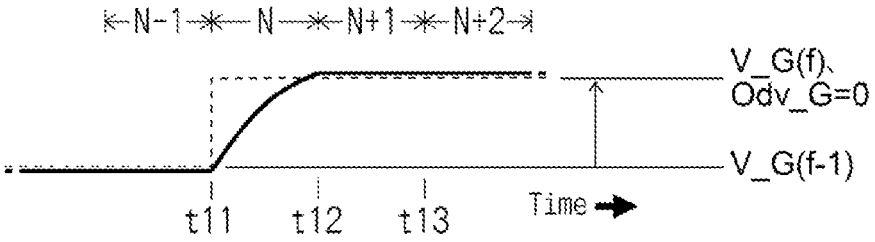
FIG. 12C is a diagram for describing the operation of the video processing circuit.

FIGS. 12A, 12B, and 12C illustrate, focusing on the given panel pixel, changes in the transmittance of the given panel pixel and the like in operations of the processing circuits 230B and 230G. More specifically, with respect to B and G, in a case in which the given gray scale level is maintained in a field (N−1) that lasts up to a timing t11, the given gray scale level changes to another gray scale level at the timing t11 at which the next field (N) starts, and the other gray scale level is maintained thereafter, FIGS. 12A, 12B, and 12C illustrate the changes in the transmittance of the given panel pixel (indicated by the thick solid lines) in association with changes in a liquid crystal voltage applied to or held in the liquid crystal element 120 (indicated by the dashed lines and hereinafter simply referred to as the "liquid crystal voltage").

With respect to the liquid crystal panel 100B, at the timing t11, when the gray scale level corresponding to the given panel pixel changes from the video data V_B (f−1) to the video data V_B (f), the data Od_B corresponding to the change in the gray scale level is output from the LUT 232 in the processing circuit 230B. Here, as described above, since the coefficient K_B is the initial value of "1", the overdrive data Od_B is equal to the data Odv_B.

Therefore, the liquid crystal voltage applied from the timing t11 to a timing t12 at which the next field (N+1) starts becomes a voltage obtained by adding, to a voltage of the gray scale level specified in the video data V_B (f), a voltage corresponding to the data Odv_B, as illustrated by the dashed line in FIG. 12A.

Note that since the liquid crystal element 120 is actually driven by an alternating current using both positive and negative polarities in order to prevent degradation of the liquid crystal 105, the liquid crystal voltage is an absolute value of a difference between a voltage of the data signal Vid_B applied to the pixel electrode 118 and the voltage LCcom applied to the common electrode 108.

Since the gray scale level does not change immediately before and after the timing t12, the liquid crystal voltage from the timing t12 to a timing t13 at which the next field (N+2) starts is zero at which the overdrive data Od_B, which is equal to the data Odv_B. Thus, at the timing t12 and thereafter, the liquid crystal voltage changes to the voltage of the gray scale level specified in the video data V_B (f).

When the change is from an achromatic color of a given brightness to an achromatic color of a different brightness, the same operation is also performed with respect to the other colors, for example, with respect to the processing circuit 230G corresponding to G. In other words, when the gray scale level corresponding to the panel pixel changes from the video data V_G (f−1) to the video data V_G (f) at the timing t11, data Od_G corresponding to the change in the gray scale level is output from the LUT 232 in the processing circuit 230G. Thus, the liquid crystal voltage applied from the timing t11 to the timing t12 at which the next field (N+1) starts becomes a voltage obtained by adding, to a voltage of the gray scale level specified in the video data V_G (f), a voltage corresponding to data Odv_G, as indicated by the dashed line in FIG. 12B.

Although not illustrated in particular, the same operation is also performed with respect to the processing circuit 230R corresponding to R.

Since the change is from an achromatic color to an achromatic color, before the change, the gray scale level specified in the video data V_B (f−1), the gray scale level specified in the video data V_G (f−1), and the gray scale level specified in the video data V_G (f−1) are equal to each other. Further, after the change, the gray scale level specified in the video data V_B (f), the gray scale level specified in the video data V_G (f), and the gray scale level specified in the video data V_R (f−1) are also equal to each other.

Thus, with respect to B and G, the temporal changes in the liquid crystal voltage, which are indicated by the dashed line in FIG. 12A, and the temporal changes in the liquid crystal voltage, which are indicated by the dashed line in FIG. 12B, are also equal to each other.

However, even when the changes in the liquid crystal voltage are the same, if the temperatures are different, the responsiveness is different, so the transmittance is different. Specifically, when the temperatures are set as defined in the relational expression (1), the responsiveness of the liquid crystal panel 100G is better than the responsiveness of the liquid crystal panel 100B, namely, the response speed is faster in the liquid crystal panel 100G. Thus, as indicated by the thick solid line in FIG. 12A, the transmittance of the liquid crystal panel 100B follows the changes in the liquid crystal voltage relatively slowly, whereas the transmittance of the liquid crystal panel 100G follows the changes in the liquid crystal voltage relatively quickly, as indicated by the thick solid line in FIG. 12B. Since the brightness of the panel pixel, which is visually recognized by humans, is reflected in an integral value of the optical responsiveness, in the given panel pixel, R and G are more brightly visible than B. As a result, the visible panel pixel is visually recognized in a colored state rather than as an achromatic color.

Note that, here, although the description is given using the case in which the temperatures are set as defined in the relational expression (1), even when the temperatures are set as defined in the relational expression (2), the panel pixel becomes brighter in the order of G, R, and B, so similarly, the panel pixel is visually recognized in the colored state.

If the change in the gray scale level occurs only at the timing t11, the color appears only momentarily and is less likely to be recognized as a deterioration in the display quality.

However, for example, when a portion of the image represented by the video data Vid-in is as illustrated in FIG. 14, more specifically, when relatively bright achromatic pixels and relatively dark achromatic pixels are alternately arranged across the row direction and the column direction, a problem is likely to arise. Note that the above-described "relatively bright achromatic color" specifically refers to a relatively light gray color having substantially the same gray scale level values for RGB. The above-described relatively dark achromatic color specifically refers to a relatively dark gray color having substantially the same gray scale level values for RGB, and is a color for which the gray scale level is lower than the gray scale level of the relatively bright achromatic color.

Note that, in FIG. 14, for convenience, pixels having the relatively bright achromatic color are illustrated in white, and pixels having the relatively dark achromatic color are illustrated in black.

When the image represented by the video data Vid-in is the pattern as illustrated in FIG. 14, the panel pixel a1 represents the light pixel A1 in the field f1, represents the dark pixel A2 in the field f2, represents the light pixel B2 in the field f3, and represents the dark pixel B1 in the field f4, as illustrated on the right side of FIG. 5

In other words, even if the image represented by the video data Vid-in is a still image, in a configuration in which the panel pixel represents a plurality of the pixels in the image represented by the video data Vid-in while the projection positions of the panel pixel are moved, depending on the pattern of the image represented by the video data Vid-in, the gray scale level specified for the panel pixel sometimes changes in each of the fields as if it is being displayed as a moving image.

Figure 13A:
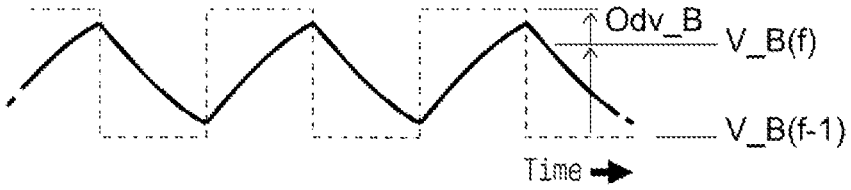
FIG. 13A is a diagram for describing the operation of the video processing circuit.

Of the pixels A1, A2, B1, and B2 displayed by the panel pixel a1 in the liquid crystal panel 100B, when the gray scale levels of the light pixels A1 and B2 are specified in the video data V_B (f) and the gray scale levels of the dark pixels A2 and B1 are specified in the video data V_B (f−1), the changes in the liquid crystal voltage are as indicated by the dashed line in FIG. 13A. Since the temperature of the liquid crystal panel 100B is low, the transmittance of the liquid crystal panel 100B follows the changes in the liquid crystal voltage relatively slowly, as indicated by the thick solid line in FIG. 13A.

Figure 13B:
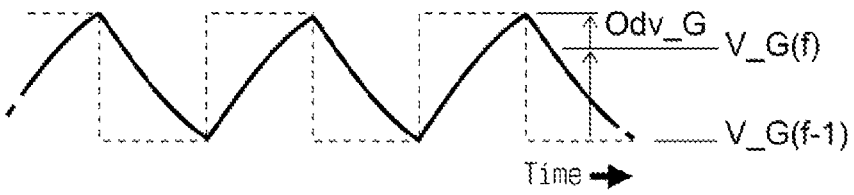
FIG. 13B is a diagram for describing the operation of the video processing circuit.

Of the pixels A1, A2, B1, and B2 displayed by the panel pixel a1 in the liquid crystal panel 100G, when the gray scale levels of the light pixels A1 and B2 are specified in the video data V_G (f) and the gray scale levels of the dark pixels A2 and B1 are specified in the video data V_G (f−1), the changes in the liquid crystal voltage are as indicated by the dashed line in FIG. 13B. Since the temperature of the liquid crystal panel 100G is high, the transmittance of the liquid crystal panel 100G follows the changes in the liquid crystal voltage relatively quickly, as indicated by the thick solid line in FIG. 13B.

Therefore, the integral value of the transmittance is higher for G than for B, and thus, G is more brightly visible than B.

Such a phenomenon in which G is more brightly visible than B occurs not only in the panel pixel a1, but also in the other panel pixels, and further, the phenomenon continues throughout a display period of the pattern illustrated in FIG. 14.

In other words, depending on the pattern of the image represented by the video data Vid-in, such coloring as described above occurs over the entire region of the pattern in a continuous manner. This thus results in a significant deterioration in the display quality.

Note that when the image represented by the video data Vid-in is, for example, an image that displays a pattern similar to the pattern illustrated in FIG. 14 with a background configured by pixels of the same gray scale level, in the pattern described above, the panel pixels change for each of the fields as if they are being displayed as a moving image. Therefore, particularly, in an edge portion of the pattern, the panel pixels are visually recognized as blurring. However, since human eyes are more sensitive to the coloring than the blurring, it is important to suppress the coloring.

In the present embodiment, in order to suppress such coloring, a configuration is adopted in which the responsiveness of the liquid crystal panel 100G is changed so as to be aligned with the responsiveness of the liquid crystal panel 100B by changing the data Odv_G added to the video data V_G (f) in the (most responsive) liquid crystal panel 100G that has the highest temperature, without changing the data Odv_B added to the video data V_B (f) in the (least responsive) liquid crystal panel 100B that has the lowest temperature.

Specifically, when the coloring occurs, the scanning control circuit 21 does not change the coefficient K_B in the processing circuit 230B from the initial value of "1", but changes the coefficient K_G in the processing circuit 230G from the initial value of "1" to a smaller value, for example, to "0".

In the processing circuit 230B, since the coefficient K_B is not changed from the initial value of "1", the changes in the gray scale level for the liquid crystal panel 100B and the changes in the transmittance for the liquid crystal panel 100B are as described in FIG. 12A or FIG. 13A.

On the other hand, in the processing circuit 230G, when the gray scale level for G is changed from the video data V_G (f−1) to the video data V_G (f), although the overdrive data Od_G corresponding to the change in the gray scale level is output from the LUT 232, since the data Od_G is multiplied by the coefficient K_G, which is zero, the data Odv_G becomes zero. Therefore, the image data V_G (f) is output from the adder 234 as it is without being corrected.

Figure 13C:
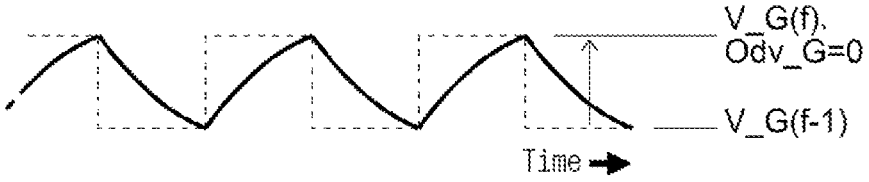
FIG. 13C is a diagram for describing the operation of the video processing circuit.

Thus, as illustrated in FIG. 12C or FIG. 13C, since the data Odv_G is zero, the effective value of the liquid crystal voltage corresponding to the video data V_G (f) becomes lower than the value illustrated in FIG. 12B or FIG. 13B.

However, since the liquid crystal panel 100G has a high temperature and good responsiveness, the changes in the transmittance of the liquid crystal panel 100G approximate the changes in transmittance of the liquid crystal panel 100B, as indicated by the thick solid line in FIG. 12C or FIG. 13C Thus, the brightness that is visually recognized as the integral value of the transmittance is substantially the same for G and B.

When the temperatures of the liquid crystal panels 100R, 100G, and 100B are as defined in the relational expression (1), the transmittance of the liquid crystal panel 100R also approximates the transmittance of the liquid crystal panel 100G, so the visually recognized brightness of R is also substantially the same as the brightness of G.

Therefore, in the present embodiment, the occurrence of the coloring due to the differences in the temperature can be made inconspicuous.

Note that although the description is made using the case in which the temperatures of the liquid crystal panels 100R, 100G, and 100B are as defined in the relational expression (1), in the case in which the temperatures are as defined in the relational expression (2), the coefficient K_R is set in accordance with the temperature of the liquid crystal panel 100R. For example, when the temperature of the liquid crystal panel 100R is close to the temperature of the liquid crystal panel 100G, the coefficient K_R is set to a value close to the coefficient K_G, and when the temperature of the liquid crystal panel 100R is close to the temperature of the liquid crystal panel 100B, the coefficient K_R is set to a value close to the coefficient K_B. Further, here, the coefficient K_G is set to "0", but when the difference between the temperature of the liquid crystal panel 100G and the temperature of the liquid crystal panel 100B is small, an operator or the like may adjust the coefficient K_G in the range from "0" to "1" so that the coloring is reduced. The coefficient K_R may be adjusted in the same manner.

Note that temperature sensors may be arranged in the liquid crystal panels 100R, 100G, and 100B, respectively, and each of the coefficients may be adjusted based on the measured temperature.

Modified Examples

The embodiment exemplified above can be modified in various manners. Specific modified modes that can be applied to the above-described embodiment will be exemplified below. Two or more modes freely selected from the examples below can be appropriately used in combination as long as mutual contradiction does not arise.

First Modified Example

In the embodiment described above, in the multiplier 233, the coefficient K_R, the coefficient K_G, and the coefficient K_B are freely set in the range from "0" to "1" with each of the initial values set to "1", but in the present modified example, the coefficients are freely set in a range from "−1" to "1" using decimal values with each of the initial values set to "1".

Figure 15A:
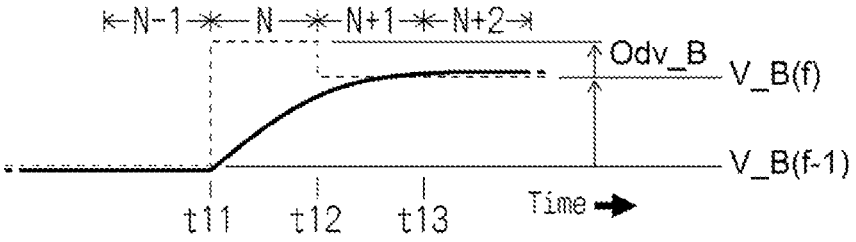
FIG. 15A is a diagram for describing the operation of the video processing circuit in a first modified example.
Figure 15B:
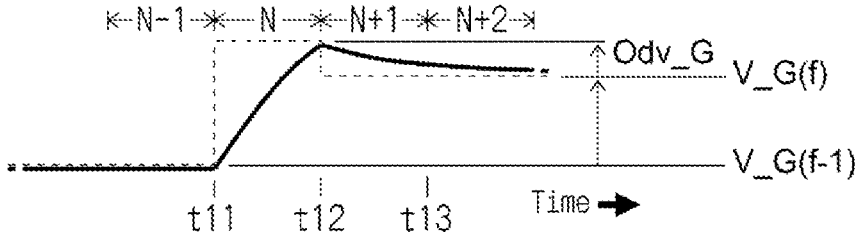
FIG. 15B is a diagram for describing the operation of the video processing circuit in the first modified example.
Figure 15C:
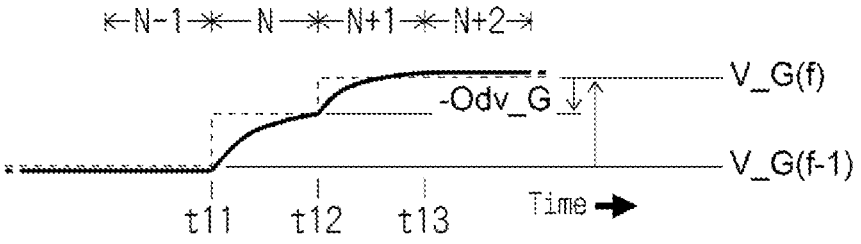
FIG. 15C is a diagram for describing the operation of the video processing circuit in the first modified example.

FIGS. 15A, 15B, and 15C illustrate, focusing on a given panel pixel, changes in the transmittance of the given panel pixel and the like in the operations of the processing circuits 230B and 230G. More specifically, with respect to B and G, in a case in which a given gray scale level is maintained in the field (N−1) that lasts up to the timing t11, the gray scale level changes from the given gray scale level to another gray scale level at the timing t11 at which the next field (N) starts, and the other gray scale level is maintained thereafter, FIGS. 15A, 15B, and 15C illustrate the changes in the transmittance of the given panel pixel (indicated by the thick solid lines) in association with changes in the liquid crystal voltage applied to or held in the liquid crystal element 120 (indicated by the dashed lines).

With respect to the liquid crystal panel 100B, at the timing t11, when the gray scale level corresponding to the given panel pixel changes from the video data V_B (f−1) to the video data V_B (f), the data Od_B corresponding to the change in the gray scale level is output from the LUT 232 in the processing circuit 230B. Here, as described above, since the coefficient K_B is the initial value of "1", the overdrive data Od_B is equal to the data Odv_B.

Therefore, the liquid crystal voltage applied from the timing t11 to the timing t12 at which the next field (N+1) starts becomes the voltage obtained by adding, to the voltage of the gray scale level specified in the video data V_B (f), the voltage corresponding to the data Odv_B as indicated by the dashed line in FIG. 15A. Note that since the liquid crystal element 120 is actually driven by the alternating current using both the positive and negative polarities in order to prevent degradation of the liquid crystal 105, the liquid crystal voltage is the absolute value of the difference between the voltage of the data signal Vid_B applied to the pixel electrode 118 and the voltage LCcom applied to the common electrode 108.

Since the gray scale level does not change immediately before and after the timing t12 and the timing t13, the liquid crystal voltage from the timing t12 to the timing t13 at which the next field (N+2) starts changes to the voltage of the gray scale level specified in the video data V_B (f) at the timing t12 and thereafter, since the overdrive data Od_B is zero.

When the change is from an achromatic color of a given brightness to an achromatic color of a different brightness, the same operation is also performed with respect to the other colors, for example, with respect to the processing circuit 230G corresponding to G. In other words, when the gray scale level corresponding to the panel pixel changes from the video data V_G (f−1) to the video data V_G (f) at the timing t11, data Od_G corresponding to the change in the gray scale level is output from the LUT 232 in the processing circuit 230G. Thus, the liquid crystal voltage applied from the timing t11 to the timing t12 at which the next field (N+1) starts becomes the voltage obtained by adding, to the voltage of the gray scale level specified in the video data V_G (f), the voltage corresponding to the data Odv_G, as indicated by the dashed line in FIG. 15B.

Although not illustrated in particular, the same operation is also performed with respect to the processing circuit 230R corresponding to R.

Since the change is from an achromatic color to an achromatic color, before the change, the gray scale level specified in the video data V_B (f−1), the gray scale level specified in the video data V_G (f−1), and the gray scale level specified in the video data V_G (f−1) are equal to each other. Further, after the change, the gray scale level specified in the video data V_B (f), the gray scale level specified in the video data V_G (f), and the gray scale level specified in the video data V_R (f−1) are also equal to each other.

Thus, with respect to B and G, the temporal changes in the liquid crystal voltage, which are indicated by the dashed line in FIG. 15A, and the temporal changes in the liquid crystal voltage, which are indicated by the dashed line in FIG. 15B, are also equal to each other.

However, even when the changes in the liquid crystal voltage are the same, if the temperatures are different, the responsiveness is different, so the transmittance is different. Specifically, when the temperatures are set as defined in the relational expression (1), the responsiveness of the liquid crystal panel 100G is better than the responsiveness of the liquid crystal panel 100B, namely, the response speed is faster in the liquid crystal panel 100G. Thus, as indicated by the thick solid line in FIG. 15A, the transmittance of the liquid crystal panel 100B follows the changes in the liquid crystal voltage relatively slowly, whereas the transmittance of the liquid crystal panel 100G follows the changes in the liquid crystal voltage relatively quickly, as indicated by the thick solid line in FIG. 15B. The responsiveness of the liquid crystal panel 100B according to the present modified example is slower than that of the above-described embodiment, and within a period from the timing t11 to the timing t12 at which the next field (N+1) starts, the transmittance of the liquid crystal panel 100B does not reach the transmittance corresponding to the gray scale level specified in the video data V_B (f). Thus, the visually recognized panel pixel is visible in the colored state rather than as the achromatic color.

Note that, here, although the description is given using the case in which the temperatures are set as defined in the relational expression (1), even when the temperatures are set as defined in the relational expression (2), the panel pixel becomes brighter in the order of G, R, and B, so similarly, the panel pixel is visually recognized in the colored state.

In the present modified example, in order to suppress such coloring, a configuration is adopted in which the responsiveness of the liquid crystal panel 100G is changed so as to be aligned with the responsiveness of the liquid crystal panel 100B by changing, at the timing t11, the data Odv_G added to the video data V_G (f) in the (most responsive) liquid crystal panel 100G that has the highest temperature, without changing the data Odv_B added to the video data V_B (f) in the (least responsive) liquid crystal panel 100B that has the lowest temperature, and, at the timing t12 subsequent to the timing t11, setting the data Odv_B added to the video data V_B (f) in the liquid crystal panel 100B to zero, and similarly, setting the data Odv_G added to the video data V_G (f) in the liquid crystal panel 100G to zero.

Specifically, when the coloring occurs, the scanning control circuit 21 does not change the coefficient K_B in the processing circuit 230B from the initial value of "1", but the scanning control circuit 21 changes the coefficient K_G in the processing circuit 230G from the initial value of "1" to a smaller value, for example, "−1".

In the processing circuit 230B, since the coefficient K_B is not changed from the initial value of "1", the changes in the gray scale level for the liquid crystal panel 100B and the changes in the transmittance for the liquid crystal panel 100B are as described in FIG. 15A.

On the other hand, in the processing circuit 230G, when the gray scale level for G is changed from the video data V_G (f−1) to the video data V_G (f), although the overdrive data Od_G corresponding to the change in the gray scale level is output from LUT 232, since the data Od_G is multiplied by the coefficient K_G, which is "−1", the data Odv_G becomes negative (−) data Odv_G.

Therefore, the liquid crystal voltage applied from the timing t11 to the timing t12 at which the next field (N+1) starts becomes a voltage obtained by subtracting, from the voltage of the gray scale level specified in the video data V_G (f), the voltage corresponding to the data Odv_G, as indicated by the dashed line in FIG. 15C.

Thus, as illustrated in FIG. 15C, since the data Odv_G is negative, the effective value of the liquid crystal voltage corresponding to the video data V_G (f) in the field (N) becomes lower than the value illustrated in FIG. 15B.

At the timing t12 at which the next field (N+1) starts, the scanning control circuit 21 changes the coefficient K_B in the processing circuit 230B from the initial value of "1" to "0", and changes the coefficient K_G in the processing circuit 230G from "−1" to "0".

Since the coefficient K_B is changed from the initial value of "1" to "0" in the processing circuit 230B, the overdrive data Od_B for the liquid crystal panel B becomes zero. Therefore, as indicated by the dashed line in FIG. 15A, the liquid crystal voltage applied from the timing t12 to the timing t13 at which the next field (N+2) starts becomes the voltage of the gray scale level specified in the video data V_B (f), and the transmittance of the liquid crystal panel 100B changes as illustrated in FIG. 15A.

Further, since the coefficient K_G is changed from "−1" to "0" in the processing circuit 230G, the overdrive data Od_G for the liquid crystal panel G becomes zero. Therefore, the liquid crystal voltage applied from the timing t12 to the timing t13 at which the next field (N+2) starts becomes the voltage of the gray scale level specified in the video data V_G (f), as indicated by the dashed line in FIG. 15C, and the transmittance of the liquid crystal panel 100G changes as illustrated in FIG. 15C.

However, since the liquid crystal panel 100G has the high temperature and good responsiveness, the changes in the transmittance of the liquid crystal panel 100G result in approximating the changes in the transmittance of the liquid crystal panel 100B illustrated in FIG. 15A, as indicated by the thick solid line in FIG. 15C. Thus, the brightness that is visually recognized as the integral value of the transmittance is substantially the same for G and B.

Note that, in the present modified example, although the coefficient K_B is set to "1" with the coefficient K_G set to "−1" at the timing t11, and the coefficient K_B is set to "0" with the coefficient K_G set to "0" at the timing t12, the present disclosure is not limited to this example. For example, the coefficient K_B may be set to "1" with the coefficient K_G set to "−1" at the timing t11, the coefficient K_B may be set to "1" with the coefficient K_G set to "−0.5" at the timing t12, and the coefficient K_B may be set to "0" with the coefficient K_G set to "0" at the timing t13.

In other words, depending on a degree of difference between the responsiveness of the liquid crystal panel B and the responsiveness of the liquid crystal panel G, the timing at which the coefficient K_B is changed from "1" to "0" may be changed, or this timing may be changed in a plurality of stages using intermediate values from "1" to "0", and in a similar manner, the timing at which the coefficient K_G is changed from "−1" to "0" may be changed, or this timing may be changed in a plurality of stages using intermediate values from "−1" to "0".

Figure 16A:
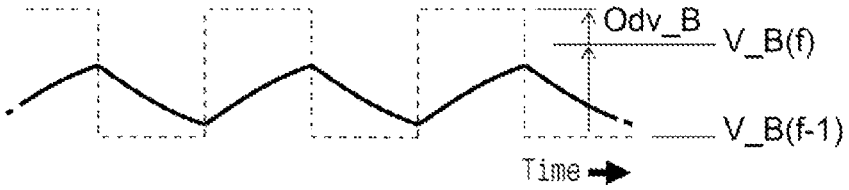
FIG. 16A is a diagram for describing the operation of the video processing circuit in a second modified example.
Figure 16B:
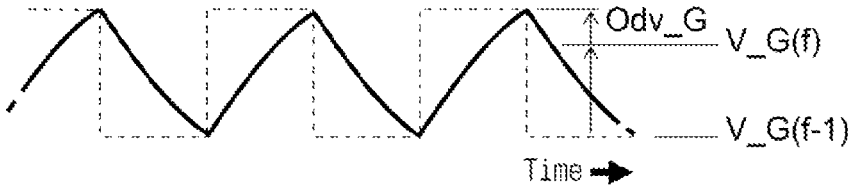
FIG. 16B is a diagram for describing the operation of the video processing circuit in the second modified example.

Note that when the image represented by the video data Vid-in is the pattern as illustrated in FIG. 14, the transmittance of the liquid crystal panel 100G having a high temperature follows the changes in the liquid crystal voltage relatively quickly, as indicated by the thick solid line in FIG. 16B. On the other hand, the transmittance of the liquid crystal panel 100B having a low temperature follows the changes in the liquid crystal voltage relatively slowly, as indicated by the thick solid line in FIG. 16A. Therefore, the coloring is more likely to be visible.

In the present modified example, in the processing circuit 230G, when the gray scale level for G is changed from the video data V_G (f−1) to the video data V_G (f), although the overdrive data Od_G corresponding to the change in the gray scale level is output from LUT 232, since the data Od_G is multiplied by the coefficient K_G, which is "−1", the data Odv_G becomes negative (−) data Odv_G. Therefore, the liquid crystal voltage applied from the timing t11 to the timing t12 at which the next field (N+1) starts becomes the voltage obtained by subtracting, from the voltage of the gray scale level specified in the video data V_G (f), the voltage corresponding to the data Odv_G, as indicated by the dashed line in FIG. 16C.

Figure 16C:
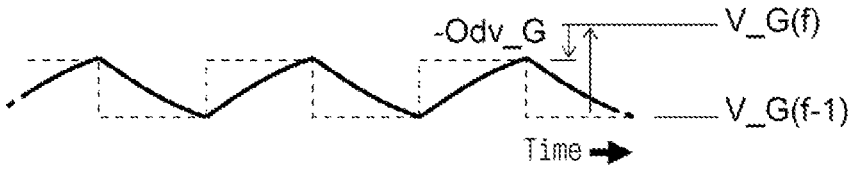
FIG. 16C is a diagram for describing the operation of the video processing circuit in the second modified example.

Thus, as illustrated in FIG. 16C, since the data Odv_G is negative, the effective value of the liquid crystal voltage corresponding to the video data V_G (f) becomes lower than the value illustrated in FIG. 16B.

However, since the liquid crystal panel 100G has the high temperature and good responsiveness, the changes in the transmittance of the liquid crystal panel 100G result in approximating the changes in the transmittance of the liquid crystal panel 100B illustrated in FIG. 16A, as indicated by the thick solid line in FIG. 16C. Thus, the brightness that is visually recognized as the integral value of the transmittance is substantially the same for G and B.

Therefore, in the present embodiment, the occurrence of the coloring due to the differences in the temperature can be made inconspicuous.

Note that although the description is made using the case in which the temperatures of the liquid crystal panels 100R, 100G, and 100B are as defined in the relational expression (1), in the case in which the temperatures are as defined in the relational expression (2), the coefficient K_R is set in accordance with the temperature of the liquid crystal panel 100R. For example, when the temperature of the liquid crystal panel 100R is close to the temperature of the liquid crystal panel 100G, the coefficient K_R is set to a value close to the coefficient K_G, and when the temperature of the liquid crystal panel 100R is close to the temperature of the liquid crystal panel 100B, the coefficient K_R is set to a value close to the coefficient K_B. Further, here, the coefficient K_G is set to "−1", but when the difference between the temperature of the liquid crystal panel 100G and the temperature of the liquid crystal panel 100B is small, the operator or the like may adjust the coefficient K_G in the range from "−1" to "1", so that the coloring becomes smaller. The coefficient K_R may also be adjusted in the same manner.

Note that temperature sensors may be arranged in the liquid crystal panels 100R, 100G, and 100B, respectively, and each of the coefficients may be adjusted based on the measured temperature.

Second Modified Example

In the present modified example, the coefficient K_R, the coefficient K_G, and the coefficient K_B are freely set in the range from "−1" to "0" using decimal values, with each of the initial values set to "0".

Figure 17A:
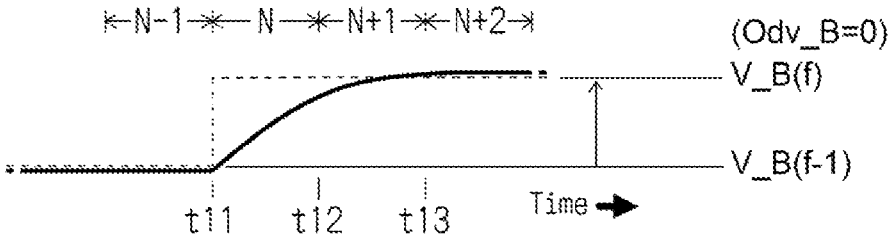
FIG. 17A is a diagram for describing the operation of the video processing circuit in a third modified example.
Figure 17B:
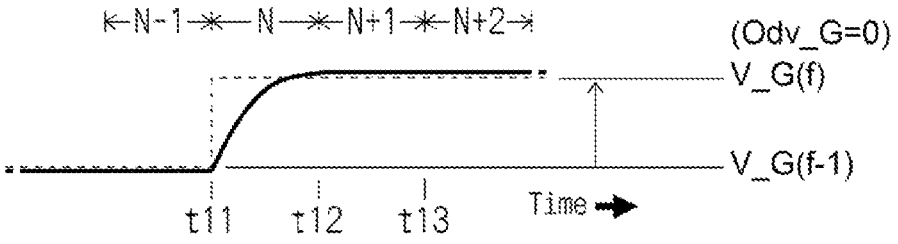
FIG. 17B is a diagram for describing the operation of the video processing circuit in the third modified example.
Figure 17C:
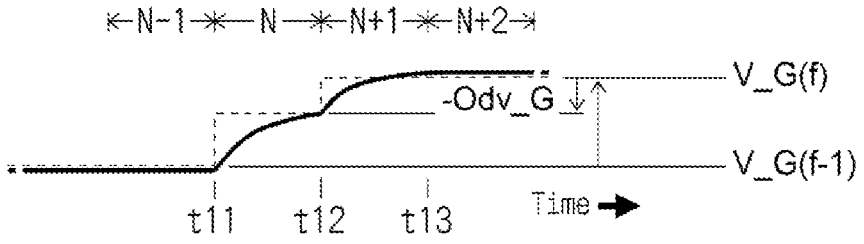
FIG. 17C is a diagram for describing the operation of the video processing circuit in the third modified example.

FIGS. 17A, 17B, and 17C illustrate, focusing on a given panel pixel, changes in the transmittance of the given panel pixel and the like in the operations of the processing circuits 230B and 230G. More specifically, with respect to B and G, in a case in which a given gray scale level is maintained in the field (N−1) that lasts up to the timing t11, the given gray scale level changes to another gray scale level at the timing t11 at which the next field (N) starts, and the other gray scale level is maintained thereafter, FIGS. 17A, 17B, and 17C illustrate the changes in the transmittance of the given panel pixel (indicated by the thick solid lines) in association with changes in the liquid crystal voltage applied to or held in the liquid crystal element 120 (indicated by the dashed lines).

With respect to the liquid crystal panel 100B, at the timing t11, when the gray scale level corresponding to the given panel pixel changes from the video data V_B (f−1) to the video data V_B (f), the data Od_B corresponding to the change in the gray scale level is output from the LUT 232 in the processing circuit 230B. In the present modified example, since the coefficient K_B is the initial value of "0", the overdrive data Od_B is equal to zero.

Therefore, the liquid crystal voltage applied from the timing t11 to the timing t12 at which the next field (N+1) starts becomes the voltage of the gray scale level specified by the video data V_B (f), as indicated by the dashed line in FIG. 17A.

Note that since the liquid crystal element 120 is actually driven by an alternating current using both positive and negative polarities in order to prevent degradation of the liquid crystal 105, the liquid crystal voltage is an absolute value of a difference between a voltage of the data signal Vid_B applied to the pixel electrode 118 and the voltage LCcom applied to the common electrode 108.

Since the gray scale level does not change immediately before and after the timing t12 and the timing t13, and since the overdrive data Od_B is zero, the liquid crystal voltage from the timing t12 to the timing t13 at which the next field (N+2) starts does not change from the voltage of the gray scale level specified in the video data V_B (f).

When the change is from an achromatic color of a given brightness to an achromatic color of a different brightness, the same operation is also performed with respect to the other colors, for example, with respect to the processing circuit 230G corresponding to G. In other words, when the gray scale level corresponding to the panel pixel changes from the video data V_G (f−1) to the video data V_G (f) at the timing t11, data Od_G corresponding to the change in the gray scale level is output from the LUT 232 in the processing circuit 230G. Thus, the liquid crystal voltage applied from the timing t11 to the timing t12 at which the next field (N+1) starts becomes the voltage of the gray scale level specified by the video data V_G (f), as indicated by the dashed line in FIG. 17B.

Although not illustrated in particular, the same operation is also performed with respect to the processing circuit 230R corresponding to R.

Since the change is from an achromatic color to an achromatic color, before the change, the gray scale level specified in the video data V_B (f−1), the gray scale level specified in the video data V_G (f−1), and the gray scale level specified in the video data V_G (f−1) are equal to each other. Further, after the change, the gray scale level specified in the video data V_B (f), the gray scale level specified in the video data V_G (f), and the gray scale level specified in the video data V_R (f−1) are also equal to each other.

Thus, with respect to B and G, the temporal changes in the liquid crystal voltage, which are indicated by the dashed line in FIG. 15A, and the temporal changes in the liquid crystal voltage, which are indicated by the dashed line in FIG. 17B, are also equal to each other.

However, even when the changes in the liquid crystal voltage are the same, if the temperatures are different, the responsiveness is different, so the transmittance is different. Specifically, when the temperatures are set as defined in the relational expression (1), the responsiveness of the liquid crystal panel 100G is better than the responsiveness of the liquid crystal panel 100B, namely, the response speed is faster in the liquid crystal panel 100G. Thus, as indicated by the thick solid line in FIG. 17A, the transmittance of the liquid crystal panel 100B follows the changes in the liquid crystal voltage relatively slowly, whereas the transmittance of the liquid crystal panel 100G follows the changes in the liquid crystal voltage relatively quickly, as indicated by the thick solid line in FIG. 17B. The responsiveness of the liquid crystal panel 100B according to the present modified example is slower than that of the above-described embodiment, and within a period from the timing t11 to the timing t12 at which the next field (N+1) starts, the transmittance of the liquid crystal panel 100B does not reach the transmittance corresponding to the gray scale level specified in the video data V_B (f). Thus, the visually recognized panel pixel is visible in the colored state rather than as the achromatic color.

Note that, here, although the description is made using the case in which the temperatures are set as defined in the relational expression (1), even when the temperatures are set as defined in the relational expression (2), the panel pixel gets brighter in the order of G, R, and B, so the panel pixel is visible in the colored state, in a similar manner.

In the present modified example, in order to suppress such coloring, a configuration is adopted in which the responsiveness of the liquid crystal panel 100G is changed so as to be aligned with the responsiveness of the liquid crystal panel 100B by setting, at the timing t11, the data Odv_B added to the video data V_B (f) in the (least responsive) liquid crystal panel 100B that has the lowest temperature to the initial value of zero and changing the data Odv_G added to the video data V_G (f) in the (most responsive) liquid crystal panel 100B that has the highest temperature, and at the timing t12 subsequent to the timing t11, setting the data Odv_B added to the video data V_B (f) in the liquid crystal panel 100B to zero, and setting the data Odv_G added to the video data V_G (f) in the liquid crystal panel 100G to zero.

Specifically, when the coloring occurs, the scanning control circuit 21 does not change the coefficient K_B in the processing circuit 230B from the initial value of "0", but the scanning control circuit 21 changes the coefficient K_G in the processing circuit 230G from the initial value of "0" to a smaller value, for example, "−1".

In the processing circuit 230B, since the coefficient K_B is not changed from the initial value of "0", the changes in the gray scale level for the liquid crystal panel 100B and the changes in the transmittance for the liquid crystal panel 100B are as described with reference to FIG. 17A.

On the other hand, in the processing circuit 230G, when the gray scale level for G is changed from the video data V_G (f−1) to the video data V_G (f), although the overdrive data Od_G corresponding to the change in the gray scale level is output from LUT 232, since the data Od_G is multiplied by the coefficient K_G, which is "−1", the data Odv_G becomes negative (−) data Odv_G.

Therefore, the liquid crystal voltage applied from the timing t11 to the timing t12 at which the next field (N+1) starts becomes the voltage obtained by subtracting, from the voltage of the gray scale level specified in the video data V_G (f), the voltage corresponding to the data Odv_G, as indicated by the dashed line in FIG. 17C.

Thus, as illustrated in FIG. 17C, since the data Odv_G is negative, the effective value of the liquid crystal voltage corresponding to the video data V_G (f) in the field (N) becomes lower than the value illustrated in FIG. 17B.

At the timing t12 at which the next field (N+1) starts, the scanning control circuit 21 sets the coefficient K_B in the processing circuit 230B to "0", and changes the coefficient K_G in the processing circuit 230G from "−1" to "0".

As indicated by the dashed line in FIG. 17A, the liquid crystal voltage applied from the timing t12 to the timing t13 at which the next field (N+2) starts becomes the voltage of the gray scale level specified in the video data V_B (f), and the transmittance of the liquid crystal panel 100B changes as illustrated in FIG. 17A.

Further, since the coefficient K_G is changed from "−1" to "0" in the processing circuit 230G, the overdrive data Od_G for the liquid crystal panel G becomes zero. Therefore, the liquid crystal voltage from the timing t12 to the timing t13 at which the next field (N+2) starts becomes the voltage of the gray scale level specified in the video data V_G (f), as indicated by the dashed line in FIG. 17C, and the transmittance of the liquid crystal panel 100G changes as illustrated in FIG. 17C.

However, since the liquid crystal panel 100G has the high temperature and good responsiveness, the changes in the transmittance of the liquid crystal panel 100G result in approximating the changes in the transmittance of the liquid crystal panel 100B illustrated in FIG. 17A, as indicated by the thick solid line in FIG. 17C. Thus, the brightness that is visually recognized as the integral value of the transmittance is substantially the same for G and B.

Note that although in the present modified example, the coefficient K_B is set to "0" with the coefficient K_G set to "−1" at the timing t11, and the coefficient K_B is set to "0" with the coefficient K_G set to "0" at the timing t12, the present disclosure is not limited to this example. For example, the coefficient K_B may be set to "0" with the coefficient K_G set to "−1" at the timing t11, the coefficient K_B may be set to "0" with the coefficient K_G set to "−0.5" at the timing t12, and the coefficient K_B may be set to "0" with the coefficient K_G set to "0" at the timing t13. In other words, depending on the degree of difference between the responsiveness of the liquid crystal panel B and the responsiveness of the liquid crystal panel G, the timing at which the coefficient K_G is changed from "−1" to "0" may be changed, or this timing may be changed in a plurality of stages using intermediate values from "−1" to "0".

Figure 18A:
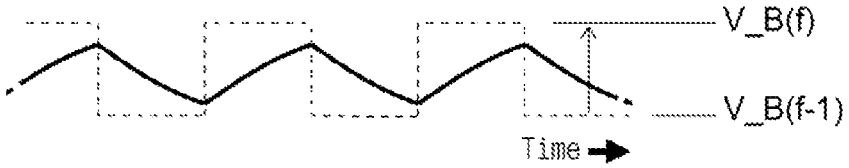
FIG. 18A is a diagram for describing the operation of the video processing circuit in the third modified example.
Figure 18B:
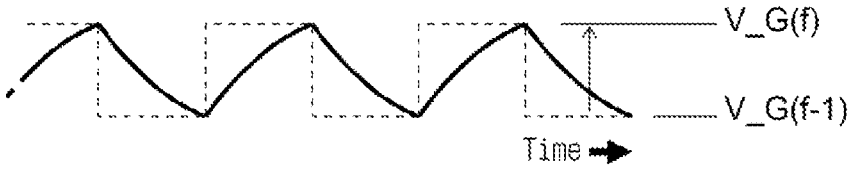
FIG. 18B is a diagram for describing the operation of the video processing circuit in the third modified example.

Note that when the image represented by the video data Vid-in is the pattern as illustrated in FIG. 14, the transmittance of the liquid crystal panel 100G having a high temperature follows the changes in the liquid crystal voltage relatively quickly, as indicated by the thick solid line in FIG. 18B. On the other hand, the transmittance of the liquid crystal panel 100B having a low temperature follows the changes in the liquid crystal voltage relatively slowly, as indicated by the thick solid line in FIG. 18A. Therefore, the coloring is more likely to be visible.

In the present modified example, in the processing circuit 230G, when the gray scale level for G is changed from the video data V_G (f−1) to the video data V_G (f), although the overdrive data Od_G corresponding to the change in the gray scale level is output from LUT 232, since the data Od_G is multiplied by the coefficient K_G, which is "−1", the data Odv_G becomes the negative (−) data Odv_G. Therefore, the liquid crystal voltage applied from the timing t11 to the timing t12 at which the next field (N+1) starts becomes the voltage obtained by subtracting, from the voltage of the gray scale level specified in the video data V_G (f), the voltage corresponding to the data Odv_G, as indicated by the dashed line in FIG. 18C.

Figure 18C:
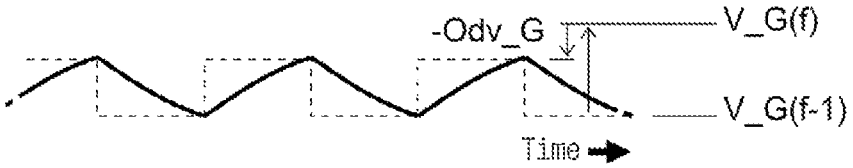
FIG. 18C is a diagram for describing the operation of the video processing circuit in the third modified example.

Thus, as illustrated in FIG. 18C, since the data Odv_G is negative, the effective value of the liquid crystal voltage corresponding to the video data V_G (f) becomes lower than the value illustrated in FIG. 18B.

However, since the liquid crystal panel 100G has the high temperature and good responsiveness, the changes in the transmittance of the liquid crystal panel 100G result in approximating the changes in the transmittance of the liquid crystal panel 100B illustrated in FIG. 18A, as indicated by the thick solid line in FIG. 18C. Thus, the brightness that is visually recognized as the integral value of the transmittance is substantially the same for G and B.

Therefore, in the present embodiment, the occurrence of the coloring due to the differences in the temperature can be made inconspicuous.

Note that although the description is made using the case in which the temperatures of the liquid crystal panels 100R, 100G, and 100B are as defined in the relational expression (1), in the case in which the temperatures are as defined in the relational expression (2), the coefficient K_R is set in accordance with the temperature of the liquid crystal panel 100R. For example, when the temperature of the liquid crystal panel 100R is close to the temperature of the liquid crystal panel 100G, the coefficient K_R is set to a value close to the coefficient K_G, and when the temperature of the liquid crystal panel 100R is close to the temperature of the liquid crystal panel 100B, the coefficient K_R is set to a value close to the coefficient K_B. Further, here, the coefficient K_G is set to "−1", but when the difference between the temperature of the liquid crystal panel 100G and the temperature of the liquid crystal panel 100B is small, the operator or the like may adjust the coefficient K_G in the range from "−1" to "0", so that the coloring becomes smaller. The coefficient K_R may also be adjusted in the same manner.

Note that temperature sensors may be arranged in the liquid crystal panels 100R, 100G, and 100B, respectively, and each of the coefficients may be adjusted based on the measured temperature.

Application Mode

In the embodiment described above, the optical responsiveness of the liquid crystal element 120 may vary depending on the cell gap, for example, and not just on the temperature.

Specifically, the responsiveness of the liquid crystal panel 100 having a narrow cell gap tends to be better compared to the responsiveness of the liquid crystal panel 100 having a wide cell gap.

Note that the difference in the responsiveness of the liquid crystal panel 100 due to the cell gap appears as a difference in characteristics of the transmittance with respect to the effective value (or the gray scale level) of the liquid crystal voltage, that is, a difference in so-called V-T characteristics.

When the cell gaps are aligned in the liquid crystal panels 100R, 100G, and 100B that are employed in the liquid crystal projector 1*a*, the responsiveness of the liquid crystal panel 100G is better than the responsiveness of the liquid crystal panel 100G, as described above. However, when the cell gaps are not aligned in the liquid crystal panels 100R, 100G, and 100G for some reason, there is a possibility that the responsiveness of the liquid crystal panel 100G may be worse than the responsiveness of the liquid crystal panel 100B. Specifically, when the cell gap of the liquid crystal panel 100G is wider than the cell gap of the liquid crystal panel 100B, even if the temperature of the liquid crystal panel 100G is higher than the temperature of the liquid crystal panel 100B, the responsiveness of the liquid crystal panel 100G may be slower than the responsiveness of the liquid crystal panel 100B.

In this manner, the responsiveness of the liquid crystal panels 100R, 100G and 100B also vary due to the difference in the cell gap, in addition to the difference in the temperature, and thus, the responsiveness of the liquid crystal panel 100B may not always be the worst.

Thus, an application mode that can also accommodate such a case will be described below.

Figure 19:
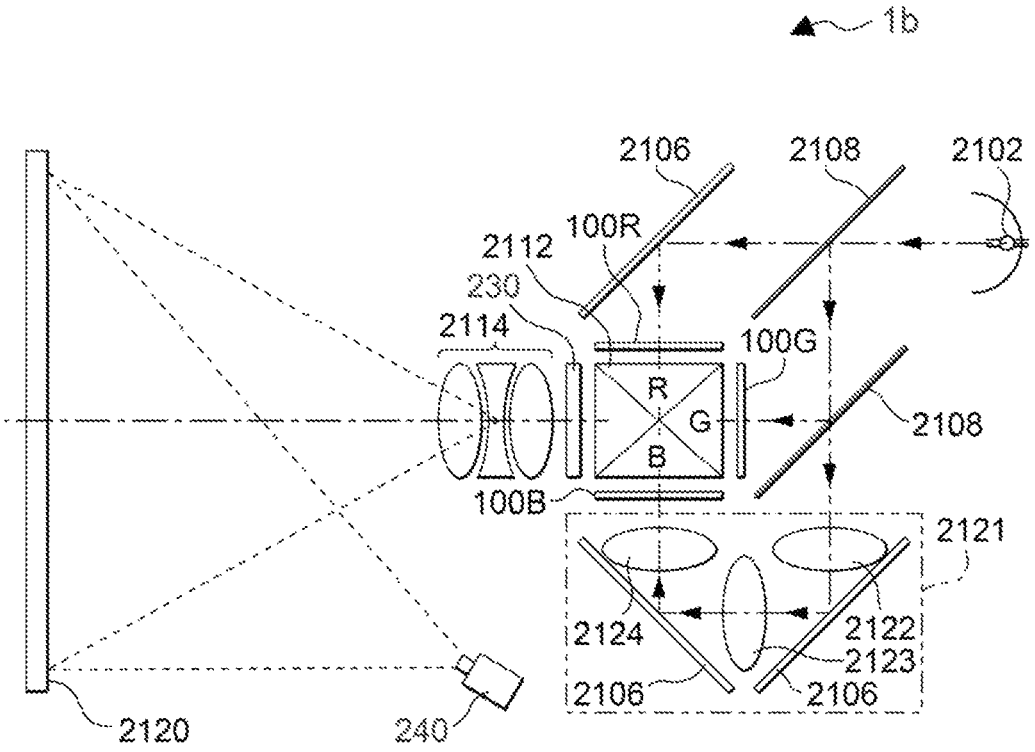
FIG. 19 is a diagram illustrating a liquid crystal projector according to an application example.

FIG. 19 is a diagram illustrating an optical configuration of a liquid crystal projector 1*b* according to the application mode. The liquid crystal projector 1*b* differs from the liquid crystal projector 1*a* illustrated in FIG. 1 in that a camera 240 is provided that captures an image projected on the screen 2120. Note that the camera 240 may be built into the liquid crystal projector 1*b*, or may be a separate body from the liquid crystal projector 1*b*.

Figure 20:
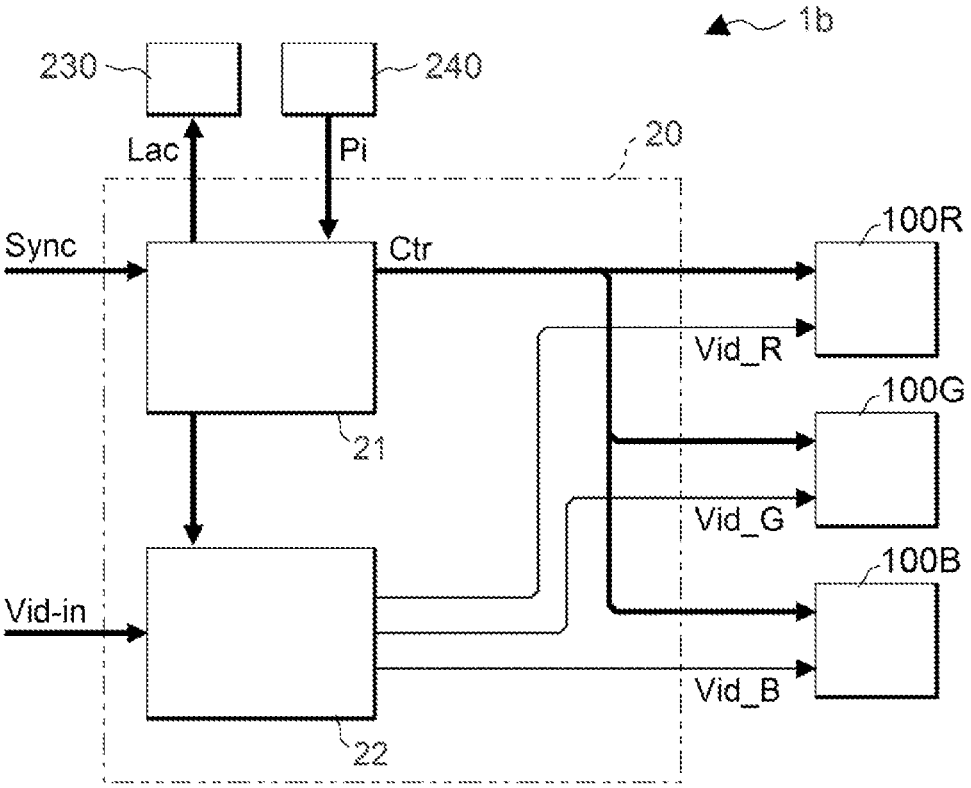
FIG. 20 is a block diagram illustrating a configuration of the liquid crystal projector according to the application example.

FIG. 20 is a block diagram illustrating an electrical configuration of the liquid crystal projector 1*b*.

As illustrated in this drawing, the camera 240 is coupled to the liquid crystal projector 1*b*, and the camera 240 supplies image capture information PI to the scanning control circuit 21.

Such functions as described below are added to the scanning control circuit 21 in the liquid crystal projector 1*b*, in comparison to the embodiment described above.

Specifically, a first function for instructing the video processing circuit 22 to output a specific image or specific pattern data in place of the image specified by the video data Vid-in, a second function for analyzing the image capture information PI and determining brightness in a freely selected region of a projection image captured by the camera 240 for each of the components R, G, and B, and a third function for changing the coefficients K_R, K_G, and K_B on the basis of the determined brightness of each of R, G, and B are added to the scanning control circuit 21.

When a specific operation is performed in the liquid crystal projector 1*b*, for example, when a switch button (not illustrated) is depressed, the video processing circuit 22 is instructed to output the following image data.

More specifically, the scanning control circuit 21 instructs the video processing circuit 22 to output image data that changes the gray scale level only for R in a stepwise manner from "0" to "255" with respect to all the panel pixels, with the gray scale levels of G and B set to "0". When the video processing circuit 22 outputs such image data, the scanning control circuit 21 acquires the V-T characteristics of the liquid crystal panel 100R by analyzing the image capture information PI and determining the transmittance of each of the gray scale levels of R. Similarly, the scanning control circuit 21 acquires the V-T characteristics of the liquid crystal panel 100G and the V-T characteristics of the liquid crystal panel 100B.

Next, the scanning control circuit 21 acquires the temperature of the liquid crystal panel 100R, the temperature of the liquid crystal panel 100G, and the temperature of the liquid crystal panel 100B. Note that detection results by a separately provided sensor may be used for acquiring the temperatures.

The scanning control circuit 21 uses the V-T characteristics and the temperatures acquired from the liquid crystal panels 100R, 100G, and 100B to identify the liquid crystal panel having the lowest responsiveness. Note that at this point, the scanning control circuit 21 sets the coefficients K_R, K_G, and K_B to the initial values of "1".

Next, the scanning control circuit 21 instructs the shift device 230 to output the video data Vid-in that represents the pattern as illustrated in FIG. 14 to the video processing circuit 22, while controlling the shift device 230 so that the projection positions are set as illustrated in FIG. 5.

Since the coefficients K_R, K_G, and K_B are "1" at this point, if there is a difference in the responsiveness, the image to be projected will not be achromatic, and the coloring occurs.

Next, the scanning control circuit 21 fixes the coefficient for the liquid crystal panel identified as having the lowest responsiveness to "1" while continuously controlling the shift device 230 and outputting the video data Vid-in to the video processing circuit 22, and gradually changes the coefficient from "1" for one of the other two liquid crystal panels. The scanning control circuit 21 stops changing the coefficient when the brightness of the color of the liquid crystal panel, for which the scanning control circuit 21 is changing the coefficient, matches the brightness of the color of the liquid crystal panel identified as having the lowest responsiveness.

Then, the scanning control circuit 21 gradually changes the coefficient from "1" for the remaining one liquid crystal panel, and stops changing the coefficient at a point when the brightness of the liquid crystal panel matches the brightness of the color of the liquid crystal panel identified as having the lowest responsiveness.

As a result, when the image specified by the video data Vid-in is the pattern as illustrated in FIG. 14, the coefficients for the other two liquid crystal panels are set so that the respective images thereof are visually recognized as achromatic in alignment with the liquid crystal panel having the lowest responsiveness.

Note that in the applied embodiment, although the coefficients for the liquid crystal panels are described based on the examples of the first embodiment, the coefficients may be configured as described in the example of other embodiment.

Note that although it is described that all the functions including the first function to the third function are performed by the scanning control circuit 21 in the application mode, the first function and the second function may be configured to be performed by another element that is specially provided, for example. The specially provided element described herein may be an element built into the liquid crystal projector 1*b*, or may be a separate element from the liquid crystal projector 1*b*.

Further, although the normally black mode is employed in the embodiment and the like described above, the present disclosure may also be applied to a normally white mode. Further, the liquid crystal panel 100R, 100G, 100G are each described as a transmissive type above, but may be a reflective type.

Note that even without shifting the projection positions by the shift device 230, the coloring occurs when the liquid crystal voltage to the panel pixels changes as indicated by the dashed lines in FIGS. 13A and 13B.

Note that in the embodiment and the like, when the responsiveness of the liquid crystal panels 100R, 100G, and 100B gets better in the order of G, R, and B, for example, G is an example of a first color, and the liquid crystal panel 100G is an example of a first liquid crystal panel.

The pixel circuit 110 in the liquid crystal panel 100G is an example of a first pixel circuit, and the data signal Vid_G is an example of a first data signal. B is an example of a second color, and the liquid crystal panel 100B is an example of a second liquid crystal panel. The pixel circuit 110 in the liquid crystal panel 100B is an example of a second pixel circuit, and the data signal Vid_B is an example of a second data signal. R is an example of a third color, the liquid crystal panel 100R is an example of a third liquid crystal panel, the pixel circuit 110 in the liquid crystal panel 100R is an example of a third pixel circuit, and the data signal Vid_R is an example of a third data signal.

The dichroic prism 2112 is an example of a synthesizing unit.

Further, the video data V_G (f−1) is an example of video data in which the gray scale level is a first value among video data of the first color, and the video data V_G (f) is an example of video data in which the gray scale level is a second value among the video data of the first color. The video data V_B (f−1) is an example of video data in which the gray scale level is the first value among video data of the second color, and the video data V_B (f) is an example of video data in which the gray scale level is the second value among the video data of the second color. The video data V_R (f−1) is an example of video data in which the gray scale level is a first value among video data of the third color, and the video data V_R (f) is an example of video data in which the gray scale level is a second value among the video data of the third color.

The data Odv_G is an example of a first correction amount, the data Odv_B is an example of a second correction amount, and the data Odv_R is an example of a third correction amount.

Since the data Odv_G, Odv_B, and Odv_R can each take a positive value or a negative value, it is necessary to refer to an absolute value thereof to determine a magnitude relationship among the data. For example, when the liquid crystal panel 100B has the worst responsiveness among the liquid crystal panels 100R, 100G, and 100B, since the coefficient K_B is "1" and the coefficients K_G and K_B are smaller than "1", of the data Odv_G, Odv_B, and Odv_R, the data Odv_B becomes the largest.

Of the projection positions determined by the shift device 230, the projection position in the field f1 is an example of a first position, and the projection position in the field f2 is an example of a second position.

What is claimed is:

1. A liquid crystal projector comprising:

a display control circuit configured to process and output, as a first data signal, video data of a first color, among video data specifying a gray scale level of a pixel, and to process and output, as a second data signal, video data of a second color different from the first color, among the video data;

a first liquid crystal panel provided corresponding to the first color and including a first pixel circuit that applies a first liquid crystal voltage corresponding to the first data signal to liquid crystal, the first pixel circuit emitting light corresponding to a transmittance of the liquid crystal;

a second liquid crystal panel provided corresponding to the second color and including a second pixel circuit that applies a second liquid crystal voltage corresponding to the second data signal to liquid crystal, the second pixel circuit emitting light corresponding to a transmittance of the liquid crystal; and a synthesizing prism configured to synthesize the emitted light from the first pixel circuit and the emitted light from the second pixel circuit, and to emit the synthesized light, wherein the gray scale level specified by the video data of the first color specifies a first value in a first field and specifies a second value in a second field subsequent to the first field, the gray scale level specified by the video data of the second color specifies the first value in the first field and the second value in the second field, and when optical responsiveness of the first liquid crystal panel is better than optical responsiveness of the second liquid crystal panel, the first liquid crystal voltage in the second field is smaller than the second liquid crystal voltage in the second field, wherein the display control circuit corrects the video data of the first color specified by the second value based on a first correction amount corresponding to an amount of change from the first value to the second value, and generates the first data signal based on the corrected video data, corrects the video data of the second color specified by the second value based on a second correction amount corresponding to the amount of change from the first value to the second value, and generates the second data signal based on the corrected video data, and the first correction amount is smaller than the second correction amount.

2. The liquid crystal projector according to claim 1 wherein the display control circuit further processes and outputs, as a third data signal, video data of a third color different from the first color and the second color, among the video data, the liquid crystal projector includes a third liquid crystal panel provided corresponding to the third color and including a third pixel circuit that applies a third voltage corresponding to the third data signal to liquid crystal, the third pixel circuit emitting light corresponding to a transmittance of the liquid crystal, the synthesizing prism further synthesizes the emitted light from the third pixel circuit with the emitted light from the first pixel circuit and the emitted light from the second pixel circuit, and when a gray scale level specified by the video data of the third color specifies a first value in the first field and a second value in the second field, the display control circuit corrects the video data of the third color specified by the second value based on a third correction amount corresponding to an amount of change from the first value to the second value, and generates the third data signal based on the corrected video data.

3. The liquid crystal projector according to claim 2, wherein when responsiveness of the third liquid crystal panel is the worst, among responsiveness of the first liquid crystal panel, responsiveness of the second liquid crystal panel, and the responsiveness of the third liquid crystal panel, the first correction amount is smaller than the second correction amount or the third correction amount.

4. The liquid crystal projector according to claim 1, wherein the display control circuit corrects the video data of the first color specified, in the second field, by the second value based on a first correction amount corresponding to an amount of change from the first value to the second value, and generates the first data signal based on the corrected video data, and the first liquid crystal voltage corresponding to the first data signal generated based on the corrected video data is smaller than a liquid crystal voltage corresponding to a data signal generated based on the video data before the correction.

5. The liquid crystal projector according to claim 1, comprising:

a shift device configured to shift, from a first position to a second position, a projection position of the synthesized light synthesized by the synthesizing prism, wherein when the first pixel circuit emits light corresponding to the first data signal based on the video data of the first color, and the second pixel circuit emits light corresponding to the second data signal based on the video data of the second color among the video data specifying a gray scale level of a first pixel, the shift device sets the projection position to the first position, and when the first pixel circuit emits light corresponding to the first data signal based on the video data of the first color, and the second pixel circuit emits light corresponding to the second data signal based on the video data of the second color among video data specifying a gray scale level of a second pixel, the shift device sets the projection position to the second position.

6. The liquid crystal projector according to claim 1, wherein the first correction amount and the second correction amount are changeable.

7. A liquid crystal projector comprising:

a display control circuit configured to process and output, as a first data signal, video data of a first color, among video data specifying a gray scale level of a pixel, and to process and output, as a second data signal, video data of a second color different from the first color, among the video data;

a first liquid crystal panel provided corresponding to the first color and including a first pixel circuit that applies a first liquid crystal voltage corresponding to the first data signal to liquid crystal, the first pixel circuit emitting light corresponding to a transmittance of the liquid crystal;

a second liquid crystal panel provided corresponding to the second color and including a second pixel circuit that applies a second liquid crystal voltage corresponding to the second data signal to liquid crystal, the second pixel circuit emitting light corresponding to a transmittance of the liquid crystal; and a synthesizing prism configured to synthesize the emitted light from the first pixel circuit and the emitted light from the second pixel circuit, and to emit the synthesized light, wherein the gray scale level specified by the video data of the first color specifies a first value in a first field and specifies a second value in a second field subsequent to the first field, the gray scale level specified by the video data of the second color specifies the first value in the first field and the second value in the second field, and when optical responsiveness of the first liquid crystal panel is better than optical responsiveness of the second liquid crystal panel, the first liquid crystal voltage in the second field is smaller than the second liquid crystal voltage in the second field, wherein the display control circuit corrects the video data of the first color specified, in the second field, by the second value based on a first correction amount corresponding to an amount of change from the first value to the second value, and generates the first data signal based on the corrected video data, and the first liquid crystal voltage corresponding to the first data signal generated based on the corrected video data is smaller than a liquid crystal voltage corresponding to a data signal generated based on the video data before the correction.

* * * * *